US011293690B1

(12) United States Patent
Whitfield et al.

(10) Patent No.: US 11,293,690 B1
(45) Date of Patent: Apr. 5, 2022

(54) MODULAR REFRIGERATION SYSTEM

(71) Applicants: Mark Whitfield, Destrehan, LA (US); James Gerard Borne, Luling, LA (US); Michael Lemcke, South Milwaukee, WI (US); Danny Palmer, Luling, LA (US)

(72) Inventors: Mark Whitfield, Destrehan, LA (US); James Gerard Borne, Luling, LA (US); Michael Lemcke, South Milwaukee, WI (US); Danny Palmer, Luling, LA (US)

( * ) Notice: Subject to any disclaimer, the term of this patent is extended or adjusted under 35 U.S.C. 154(b) by 260 days.

(21) Appl. No.: 16/581,062

(22) Filed: Sep. 24, 2019

Related U.S. Application Data

(60) Provisional application No. 62/862,386, filed on Jun. 17, 2019, provisional application No. 62/847,465, filed on May 14, 2019, provisional application No. 62/847,201, filed on May 13, 2019, provisional application No. 62/801,180, filed on Feb. 5, 2019, provisional application No. 62/798,810, filed on Jan. 30, 2019, provisional application No. 62/782,849, filed on Dec. 20, 2018, provisional application No. 62/780,043, filed on Dec. 14, 2018.

(51) Int. Cl.

| | |
|---|---|
| ***F25D 9/00*** | (2006.01) |
| ***F25D 29/00*** | (2006.01) |
| ***F25D 17/06*** | (2006.01) |
| ***F25D 17/02*** | (2006.01) |
| ***F25D 23/06*** | (2006.01) |
| ***F25D 11/02*** | (2006.01) |

(52) U.S. Cl.
CPC ..... *F25D 29/00* (2013.01); *F25D 11/022* (2013.01); *F25D 17/02* (2013.01); *F25D 17/067* (2013.01); *F25D 23/063* (2013.01); *F25D 23/069* (2013.01); *F25D 2400/14* (2013.01); *F25D 2700/121* (2013.01); *F25D 2700/122* (2013.01)

(58) Field of Classification Search
CPC .... F25D 17/02; F25D 23/063; F25D 2400/14; F25D 17/067
See application file for complete search history.

(56) References Cited

U.S. PATENT DOCUMENTS

| | | | | |
|---|---|---|---|---|
| 9,167,721 | B2 * | 10/2015 | Campbell | H05K 7/20781 |
| 10,436,495 | B2 * | 10/2019 | Srichai | F25B 5/00 |
| 2017/0268814 | A1 * | 9/2017 | Sigety | F25D 17/06 |
| 2017/0374761 | A1 * | 12/2017 | Zimmerman, Sr. | H05K 7/20281 |
| 2019/0178506 | A1 * | 6/2019 | Freiherr | F24F 13/20 |

* cited by examiner

*Primary Examiner* — Filip Zec
(74) *Attorney, Agent, or Firm* — Raymond G. Areaux; J. Matthew Miller, III; Carver, Darden, Koretzky, Tessier, Finn, Blossman & Areaux, LLC

(57) ABSTRACT

Exemplary embodiments provide a refrigeration system having an interior space cooled by a plurality of cooling. Each cooling unit is capable of operating either synchronously when in communication with a control panel or under independent operation. Each cooling unit is modularly and replaceable without the use of tools by means of a quick connect system. The cooling units use a heat exchanger cooled by chilled water and make use of an electronic super heat control and electronic expansion valve to regulate the flow of refrigerant for improved efficiency.

18 Claims, 26 Drawing Sheets

MODULAR REFRIGERATION SYSTEM

CROSS-REFERENCE TO RELATED APPLICATIONS

This application claims priority from U.S. Provisional Application No. 62/780,043 (Whitfield et al.), filed Dec. 14, 2018; U.S. Provisional Application No. 62/782,849 (Whitfield et al.), filed Dec. 20, 2018; U.S. Provisional Application No. 62/798,810 (Whitfield et al.) filed Jan. 30, 2019; U.S. Provisional Application No. 62/801,180 (Whitfield et al.) filed Feb. 5, 2019, U.S. Provisional Application No. 62/847,201 (Whitfield et al.) filed May 13, 2019; U.S. Provisional Application No. 62/847,465 (Whitfield et al.) filed May 14, 2019; and U.S. Provisional Application No. 62/862,386 (Whitfield et al.) filed Jun. 17, 2019, which are each incorporated herein by reference as if set forth in full below.

BACKGROUND OF THE INVENTION

I. Field

The present invention relates to a modular refrigeration system suitable for use in offshore, marine, or other inhospitable environments, as well as in commercial refrigeration, bulk perishable storage, and mobile refrigeration environments.

II. Background

SUMMARY OF THE INVENTION

In accordance with the invention, disclosed herein is a refrigeration system comprising a plurality of insulated walls forming an interior space; a plurality of modular refrigeration units capable of cooling said interior space, each comprising a heat exchanger, an evaporator, and a compressor; and a control panel capable of communication with each of said plurality of modular refrigeration units and capable of coordinating synchronous operation of said plurality of modular refrigeration units, wherein said plurality of insulated walls comprise a plurality of holes capable of receiving any one of said plurality of modular refrigeration units, and wherein said control panel further comprises a panel thermometer capable of detecting an interior temperature of said interior space and said plurality of modular refrigeration units synchronously cool said interior space in response to said interior temperature when said plurality of modular refrigeration units are in communication with said control panel.

BRIEF DESCRIPTION OF THE DRAWINGS

FIGS. 4A and 48 depict a wiring diagram of the components of a modular refrigeration unit.

Figure 1A:
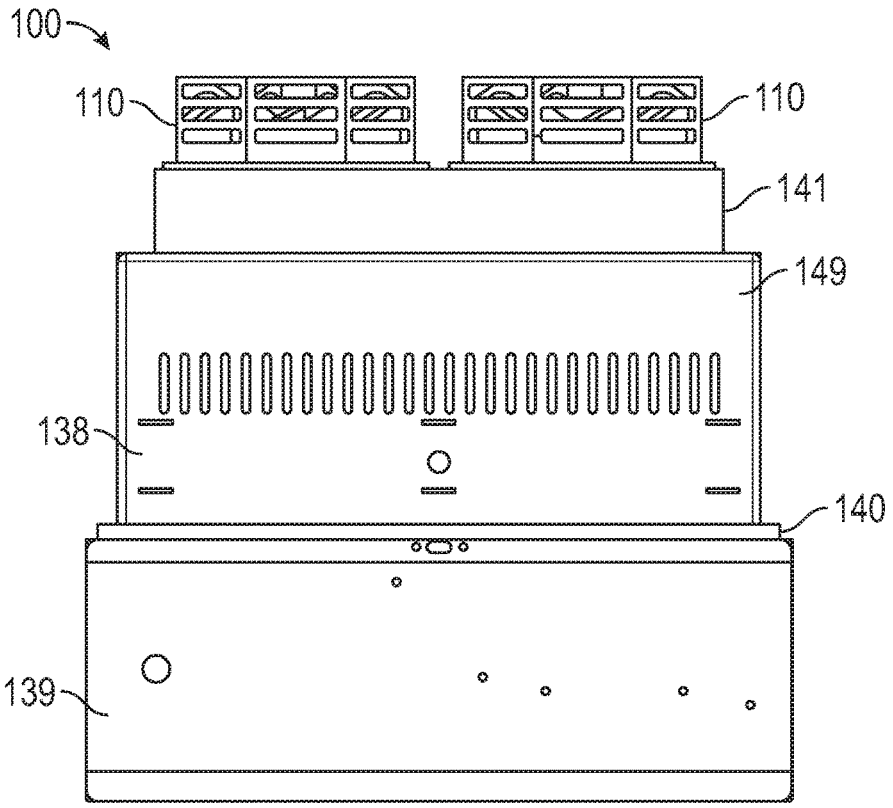
FIG. 1A depicts a bottom view of a modular refrigeration unit.
Figure 1B:
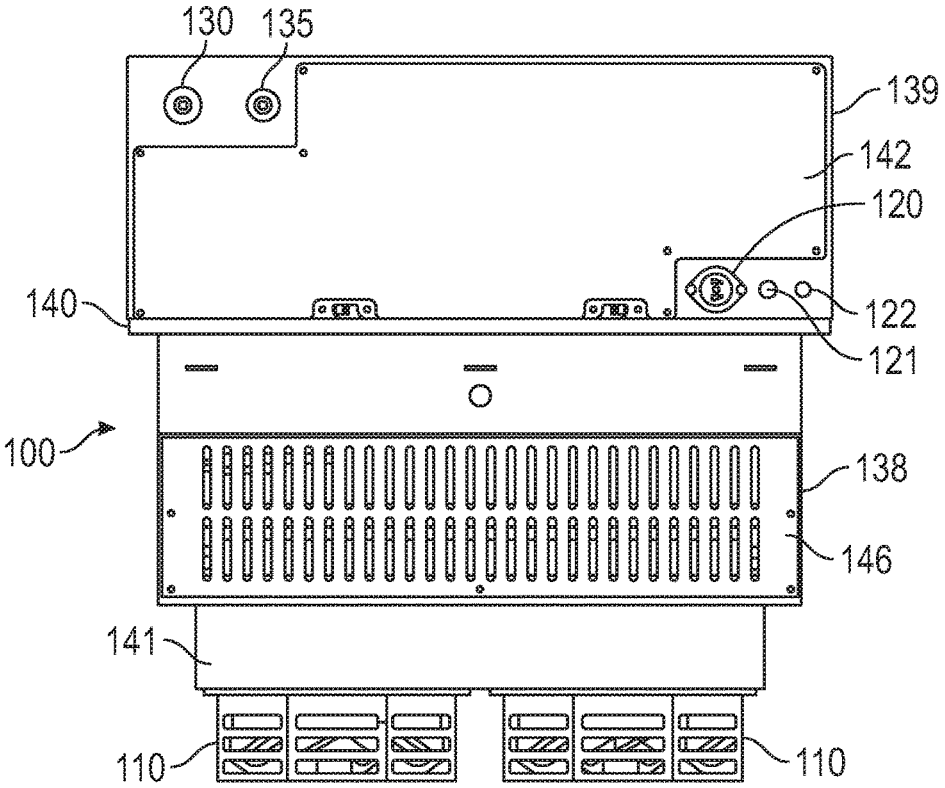
FIG. 1B depicts a top view of a modular refrigeration unit.
Figure 1C:
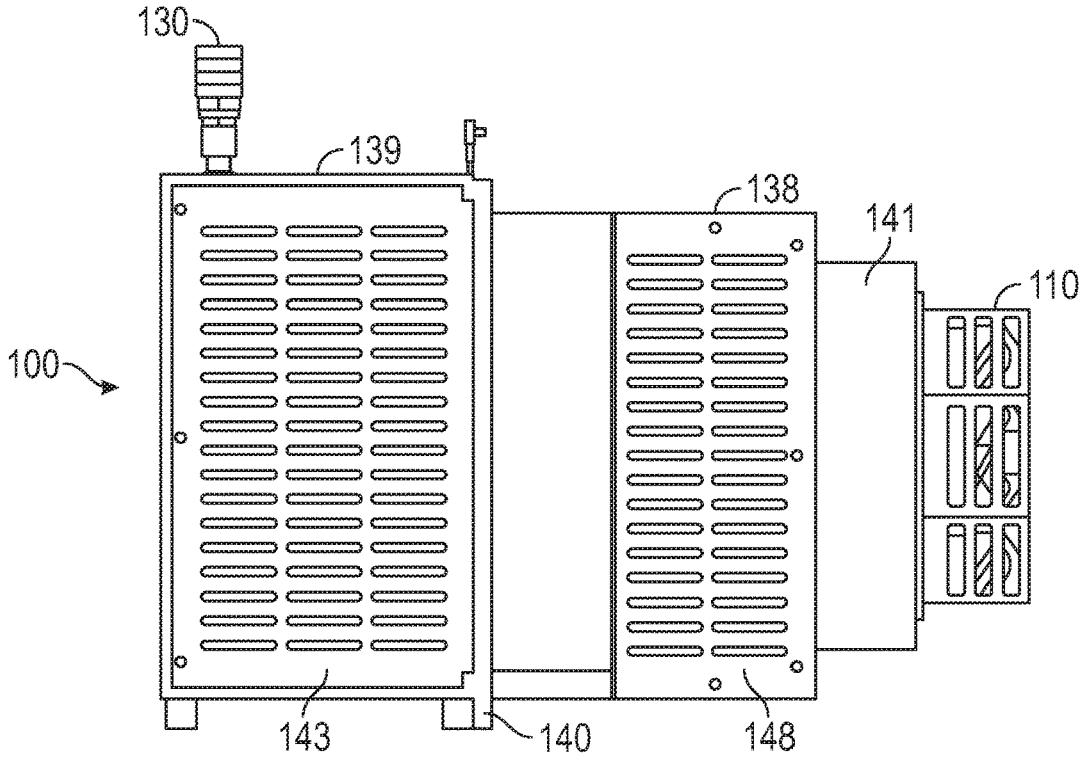
FIG. 1C depicts a side view of a modular refrigeration unit.
Figure 1D:
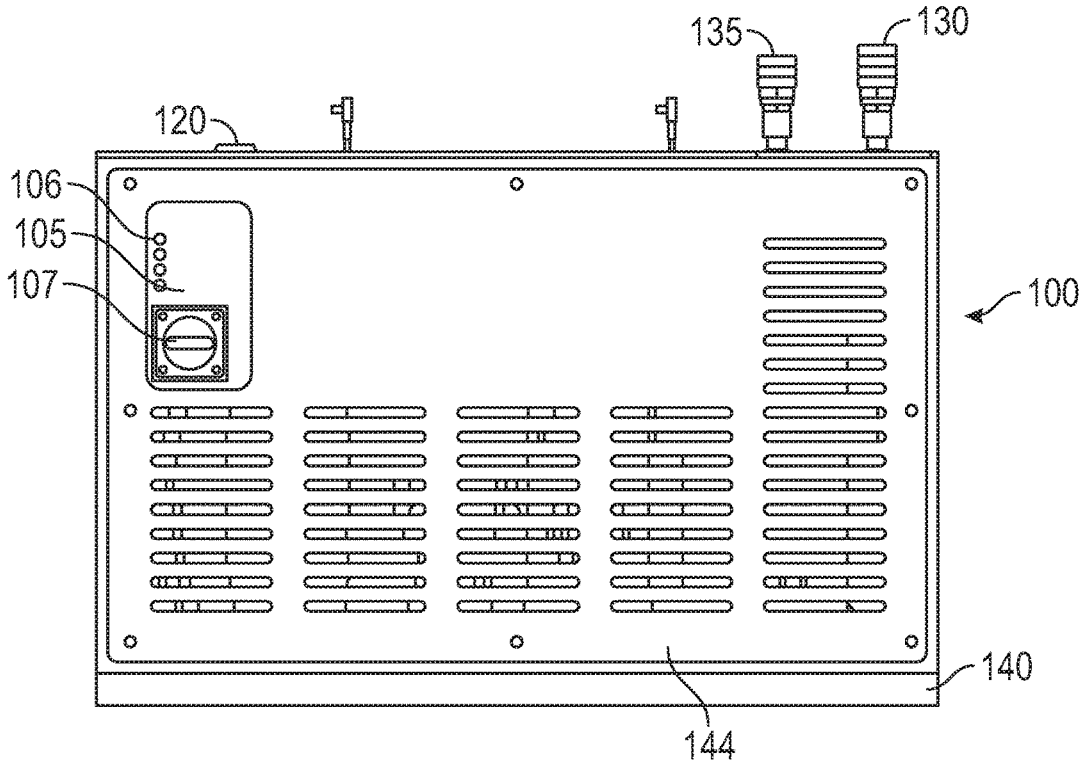
FIG. 1D depicts a rear view of a modular refrigeration unit.
Figure 1E:
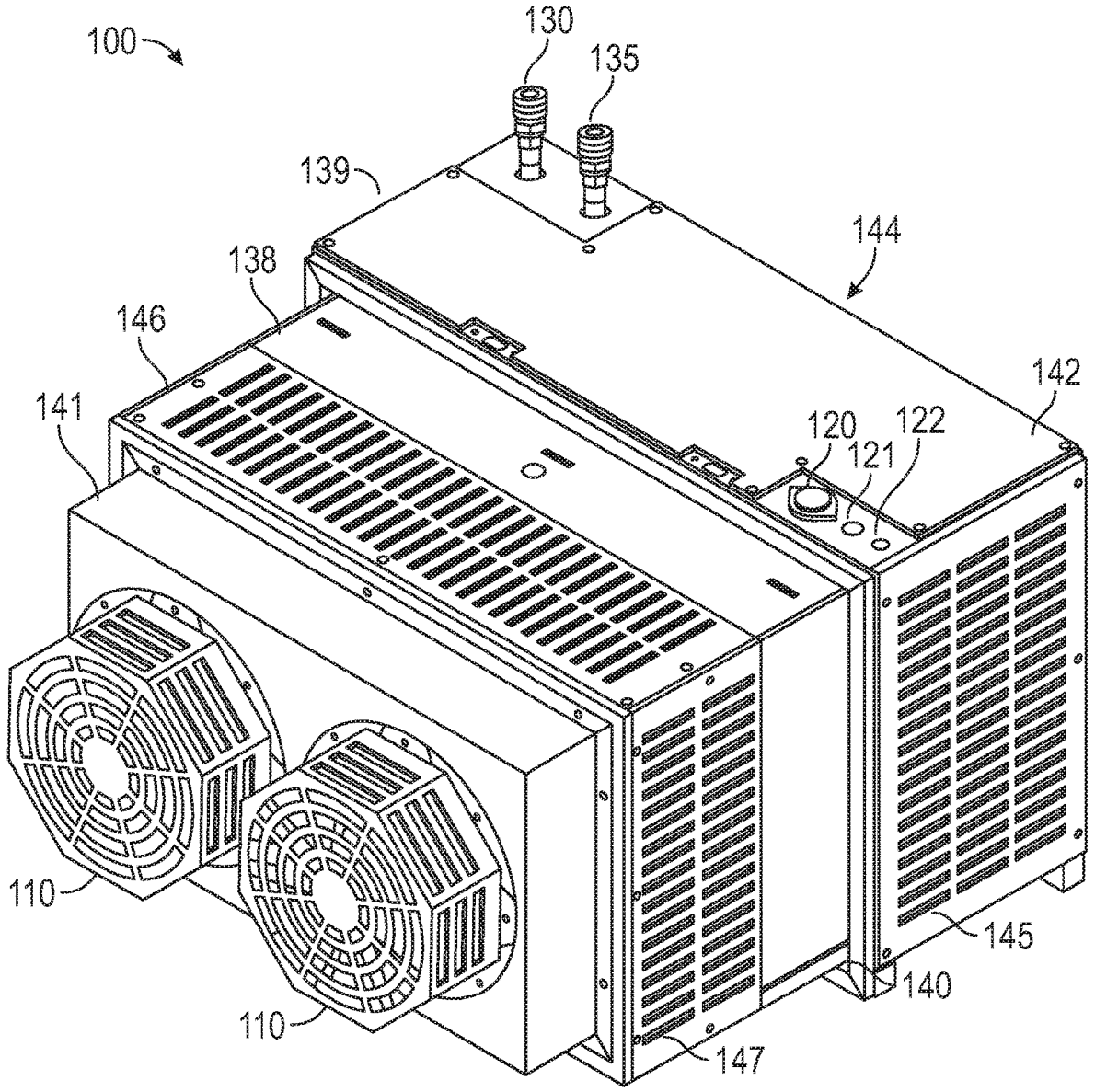
FIG. 1E depicts a perspective view of a modular refrigeration unit.

The images in the drawings are simplified for illustrative purposes and are not depicted to scale. Within the descriptions of the figures, similar elements are provided similar names and reference numerals as those of the previous figure(s). The specific numerals assigned to the elements are provided solely to aid in the description and are not meant to imply any limitations (structural or functional) on the invention.

The appended drawings illustrate exemplary configurations of the invention and, as such, should not be considered as limiting the scope of the invention that may admit to other equally effective configurations. It is contemplated that features of one configuration may be beneficially incorporated in other configurations without further recitation.

DETAILED DESCRIPTION OF THE INVENTION

Refrigeration systems and freezers are known in the art. The disclosed invention incorporates known principles of thermodynamics to create a modular refrigeration unit that can be easily removed, without the use of tools, from a modular refrigeration system and which is capable of independent operation or is capable of synchronous operation when in communication with and under the control of a control panel 305.

As used herein, the term "refrigeration unit" means a refrigeration unit that contains a compressor, an evaporator, a heat exchanger, refrigerant, and one or more fans that uses properties of thermodynamics to use the compressor and heat exchanger to flow cooled refrigerant through the evaporator, wherein the one or more fans blow air across the evaporator causing that air to become cooled.

As used herein, the term "modular refrigeration unit" means a refrigeration unit that is similar in size, shape, or function to others in a group of modular refrigeration units and wherein one modular refrigeration unit in a group can replace another modular refrigeration unit in that group.

As used herein, the term "modular refrigeration system" means a refrigeration system that comprises a plurality of modular refrigeration units.

Figure 1F:
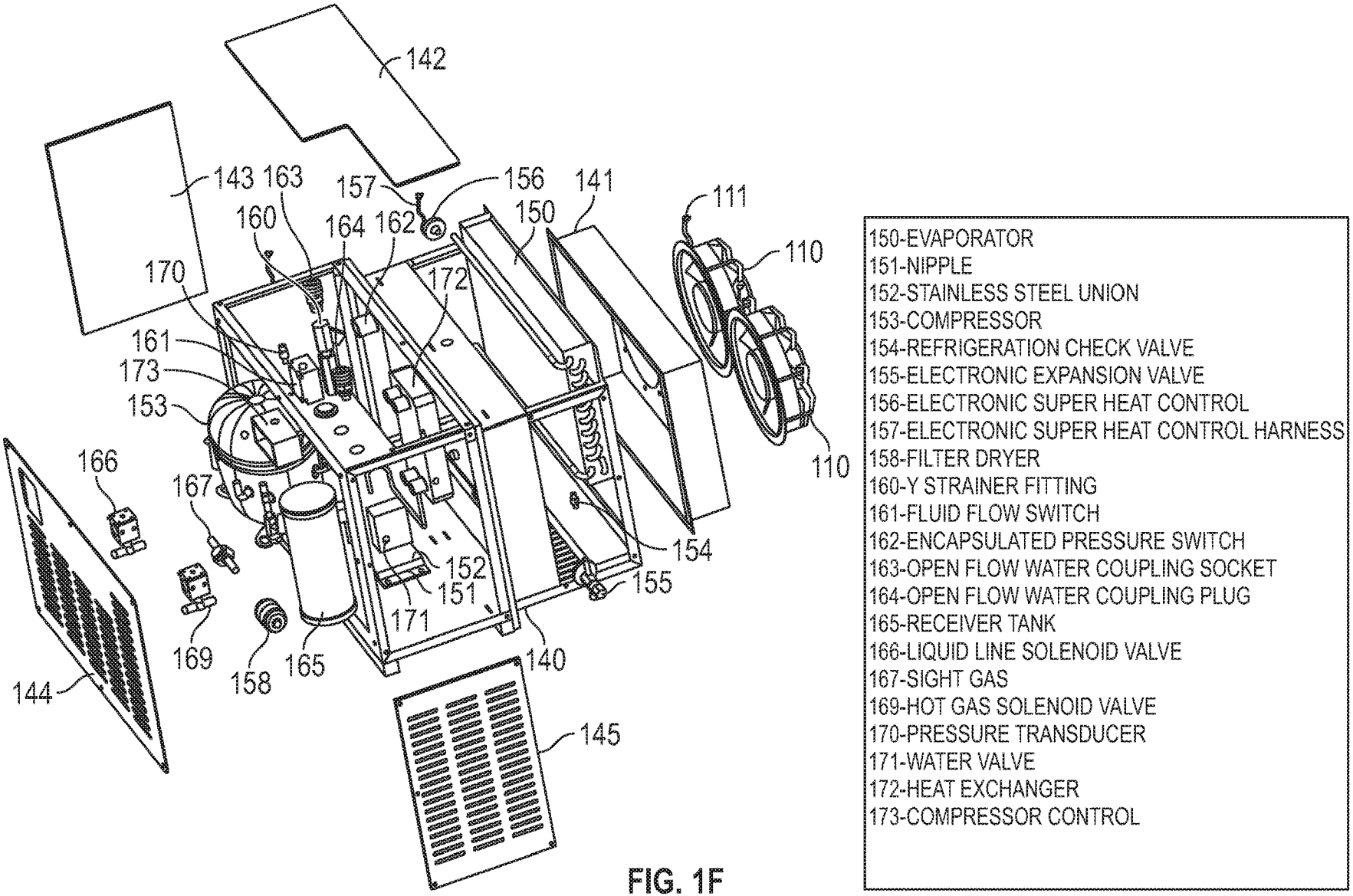
FIG. 1F depicts an exploded view of a modular refrigeration unit.

Turning now to the figures, FIGS. 1A-1F depict an embodiment of a modular refrigeration unit 100, with FIGS. 1A-1E depicting the exterior of one such embodiment, and FIG. 1F depicting an exploded view of the interior. These figures depict the approximate relative positions of the depicted elements, with interconnections and operations discussed in reference to FIGS. 4A, 48, and 8.

In one embodiment, modular refrigeration unit 100 is comprised of a frame 140 having extension 141. Frame 140 is enclosed by body top plate 142, first body side plate 143, body rear plate 144, second body side plate 145, with such plates forming a main body 139 of modular refrigeration unit 100. Frame 140 is also enclosed by evaporator enclosure top plate 146, second evaporator enclosure side plate 147, first evaporator enclosure side plate, and evaporator enclosure bottom plate 149, forming an evaporator enclosure 138. Extension 141 connects to frame 140 at evaporator enclosure 138. A plurality of axial fans 110, each having an axial fan cord 111 are attached to modular refrigeration unit 100 at extension 141. Axial fan cord 111 provides and electrical connection to unit PCB 410 (shown in FIGS. 4A and 4B). In use, evaporator enclosure 138 and extension 141 are inserted into a to-be-chilled area of modular refrigeration system 200 (not depicted in FIGS. 1A-1F, but see FIGS. 2A-2C) and the plurality of axial fans 110 blow chilled air into an interior space 280 (not shown in FIGS. 1A-1F, but see FIGS. 2B-2C) of modular refrigeration system 200.

Figure 4A:
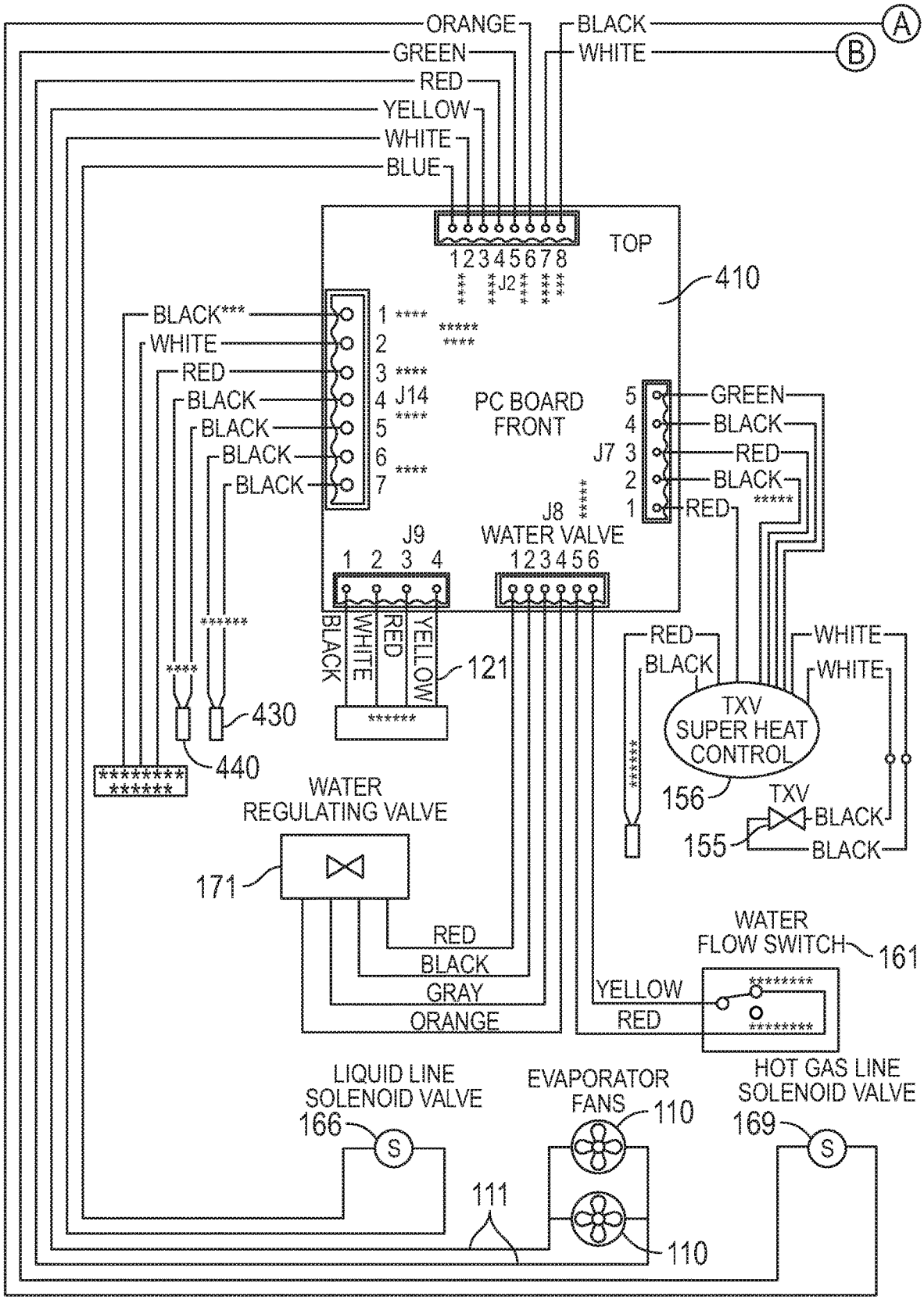
Figure 4B:
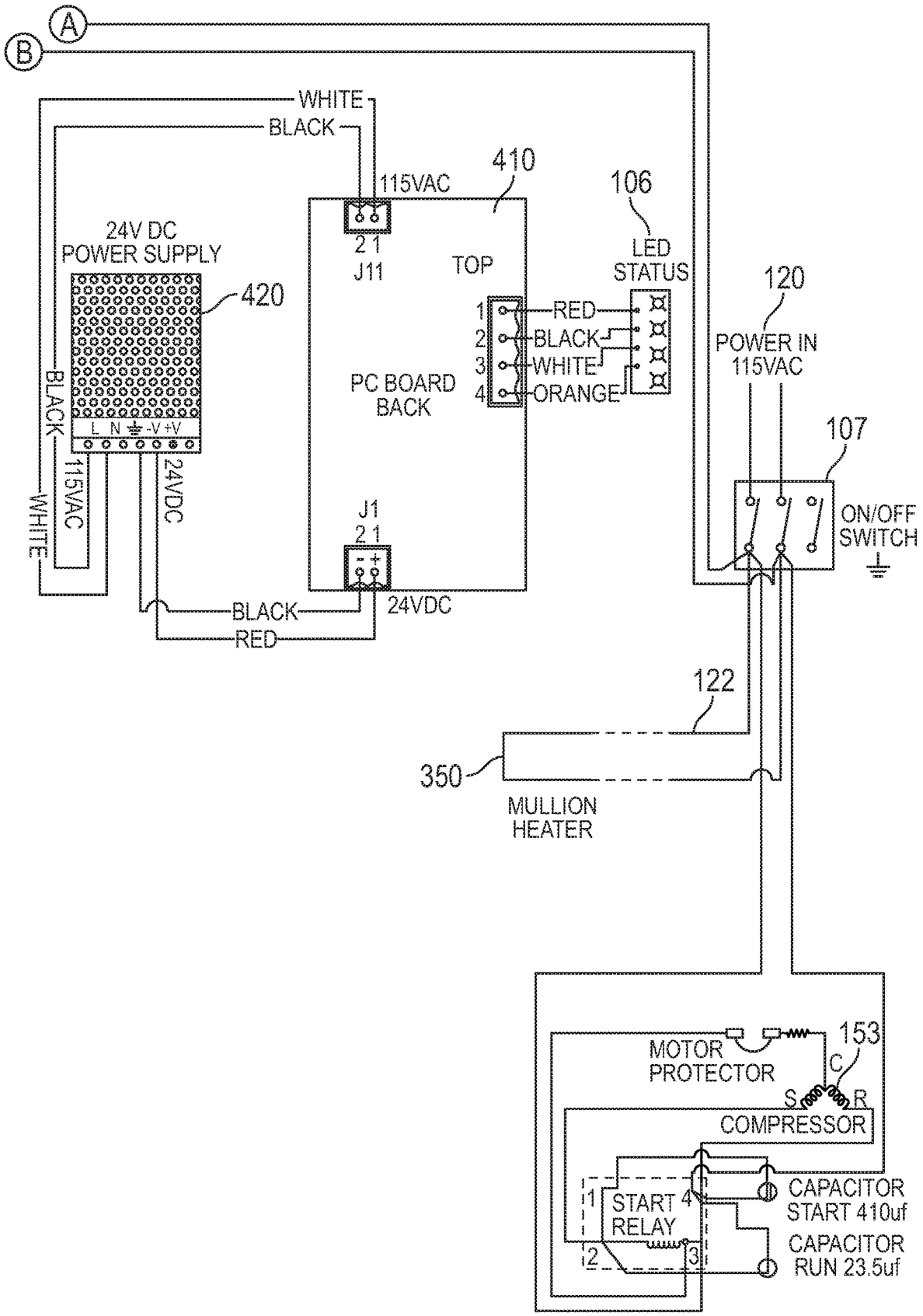

In an embodiment, modular refrigeration unit 100 comprises an operation control panel 105 having one or more operation indicators 106 and an operation switch 107. Operation indicators 106 each independently visually indicate whether modular refrigeration unit 100: (i) is operating normally as part of a cooler/refrigerator system; (ii) is operating normally as part of a freezer system; (iii) is in a fault mode; and (iv) is receiving power. Operation switch 107 turns modular refrigeration unit 100 on and off. In an embodiment, modular refrigeration unit 100 comprises an input power socket 120 for providing power to modular refrigeration unit 100, a communications cable 121 for communicating with a control panel 305, an output power socket 122 for providing power to a mullion heater 350 for preventing frost buildup on wall 250 of modular refrigeration system 200 at seam 950. Input power socket 120 receives 120 volt alternating circuit power and provides power to unit PCB 410, which in turn provides power to other electrical components of modular refrigeration unit 100, some through unit power supply 420 as shown in FIGS. 4A and 4B. Input power socket 120 provides a direct electrical connection to output power socket 122 as shown in FIG. 4B. Output power socket 122 provides electrical power to components exterior to modular refrigeration unit 100. In one embodiment, output power socket 122 is connected to and provides power to a mullion heater 350, which provides a defrost function around the seam formed when modular refrigeration unit 100 is inserted into modular refrigeration system 200. Communications cable 121 provides an electrical data connection, allowing for communication, between modular refrigeration unit 100 and a control panel 305 of modular refrigeration system 200, which in certain embodiments is either a freezer control panel 310 (where modular refrigeration unit 100 is used as part of a freezer) or a cooler control panel 320 (where modular refrigeration unit 100 is used as part of a cooler/refrigerator). In some embodiments, communications cable 121 is a 20 mA optocoupled circuit, and components of modular refrigeration system 200 (i.e., modular refrigeration unit 100 and either cooler control panel 320 or freezer control panel 310) communicate over communications cable 121 using a universal asynchronous receiver-transmitter (UART) communicating at 9600 bits per second, eight data bits, no parity bit, and one stop bit (i.e., UART 9600 8N1). However, other communications protocols may be used. We speculate that a 20 mA circuit reduces noise susceptibility. Use of this circuit also isolates DC power, ground, and signals of each control from the others with opto-isolators that provide 600 volts of isolation. We also speculate that this prevents failure and possible damage to the system through serial communications if any of the control circuitry is subjected to a higher than normal voltage.

In an embodiment, modular refrigeration unit 100 comprises chilled water inlet 130 for accepting chilled water and chilled water outlet 135 for allowing chilled water to flow out of modular refrigeration unit 100. We speculate that, so long as water entering chilled water inlet 130 is a lower temperature than the compressed refrigerant 185 flowing through evaporator 150 of modular refrigeration unit 100, modular refrigeration unit 100 will work. However, we speculate that modular refrigeration unit 100 will work better as the temperature of water entering chilled water inlet 130 decreases. In some embodiments, the water provided to modular refrigeration unit 100 is chilled to between 42 degrees Fahrenheit and 46 degrees Fahrenheit before it is provided to modular refrigeration unit 100. Chilled water inlet 130 and chilled water outlet 135 are each quick connect fittings of opposite gender (i.e., in an embodiment, chilled water inlet 130 in male and chilled water outlet 135 is female). We speculate that having these fittings of opposite gender will avoid the problem of connecting chilled water pipes incorrectly.

Modular refrigeration unit 100 also comprises a unit PCB 410 (shown in FIGS. 4A and 4B). Unit PCB 410 is electrically connected to components of modular refrigeration unit 100 and controls the operation of said components as discussed in reference to FIGS. 4A, 4B, and 8. In some embodiments, unit PCB 410 is a printed circuit board containing one or more logic chips, including, without limitation, application specific integrated circuits (ASICs), field programmable gate arrays (FPGAs), microcontrollers, microprocessors, or other electrical components capable of directing the control of components as discussed herein.

FIG. 1F shows an exploded view of an interior of an embodiment of a modular refrigeration unit 100, comprising evaporator 150, nipple 151, stainless steel union 152, compressor 153, refrigeration check valve 154, electronic expansion valve 155, electronic super heat control 156, electronic super heat control harness 157, filter dryer 158, bell reducer fitting 159, y strainer fitting 160, fluid flow switch 161, encapsulated pressure switch 162, open flow water coupling socket 163, open flow water coupling plug 164, receiver 165, liquid line solenoid valve 166, sight glass 167, hot gas solenoid valve 169, pressure transducer 170, water valve 171, heat exchanger 172, and compressor control 173.

Figure 2A:
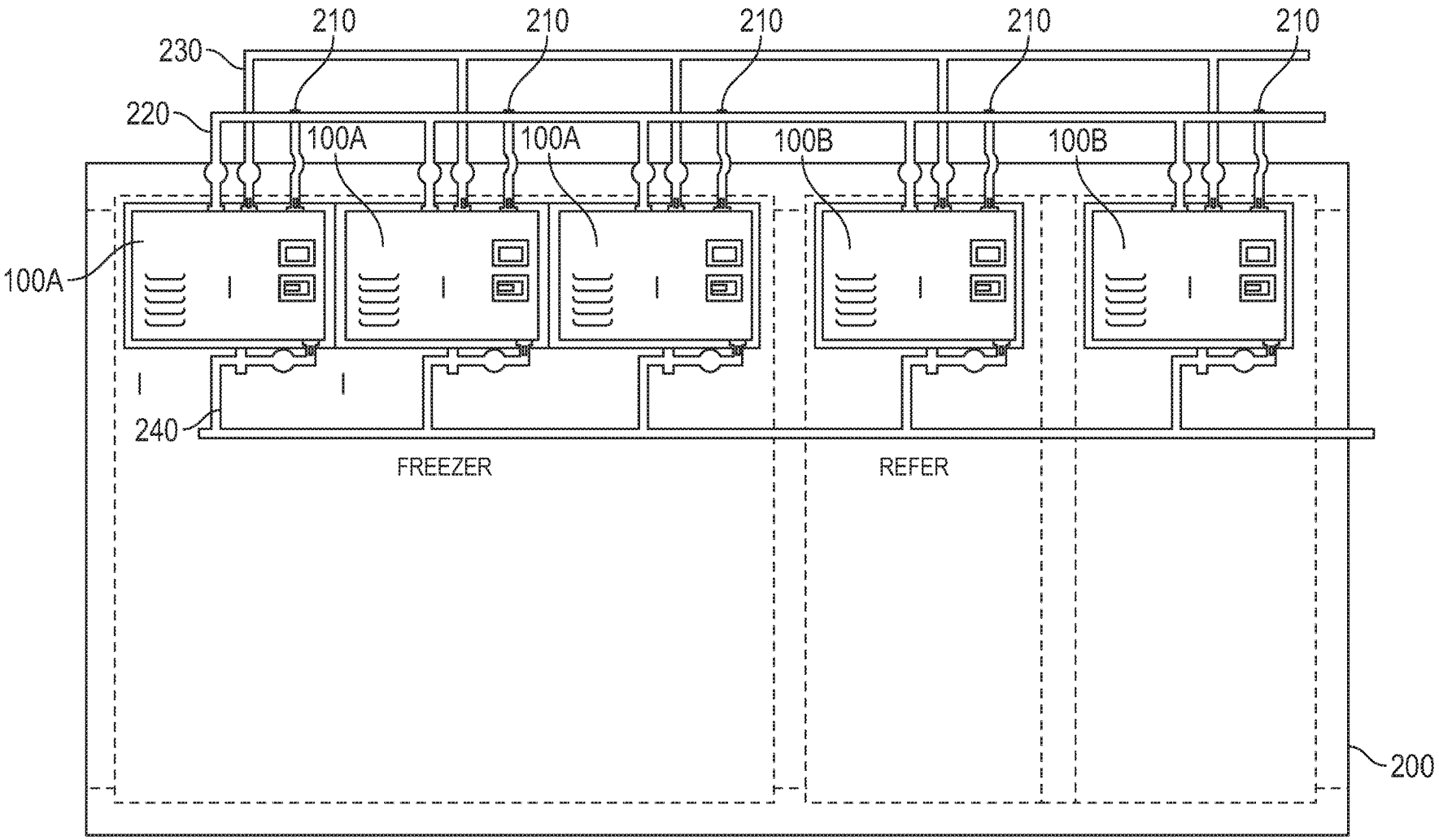
FIG. 2A depicts a side view of a modular refrigeration system.
Figure 2B:
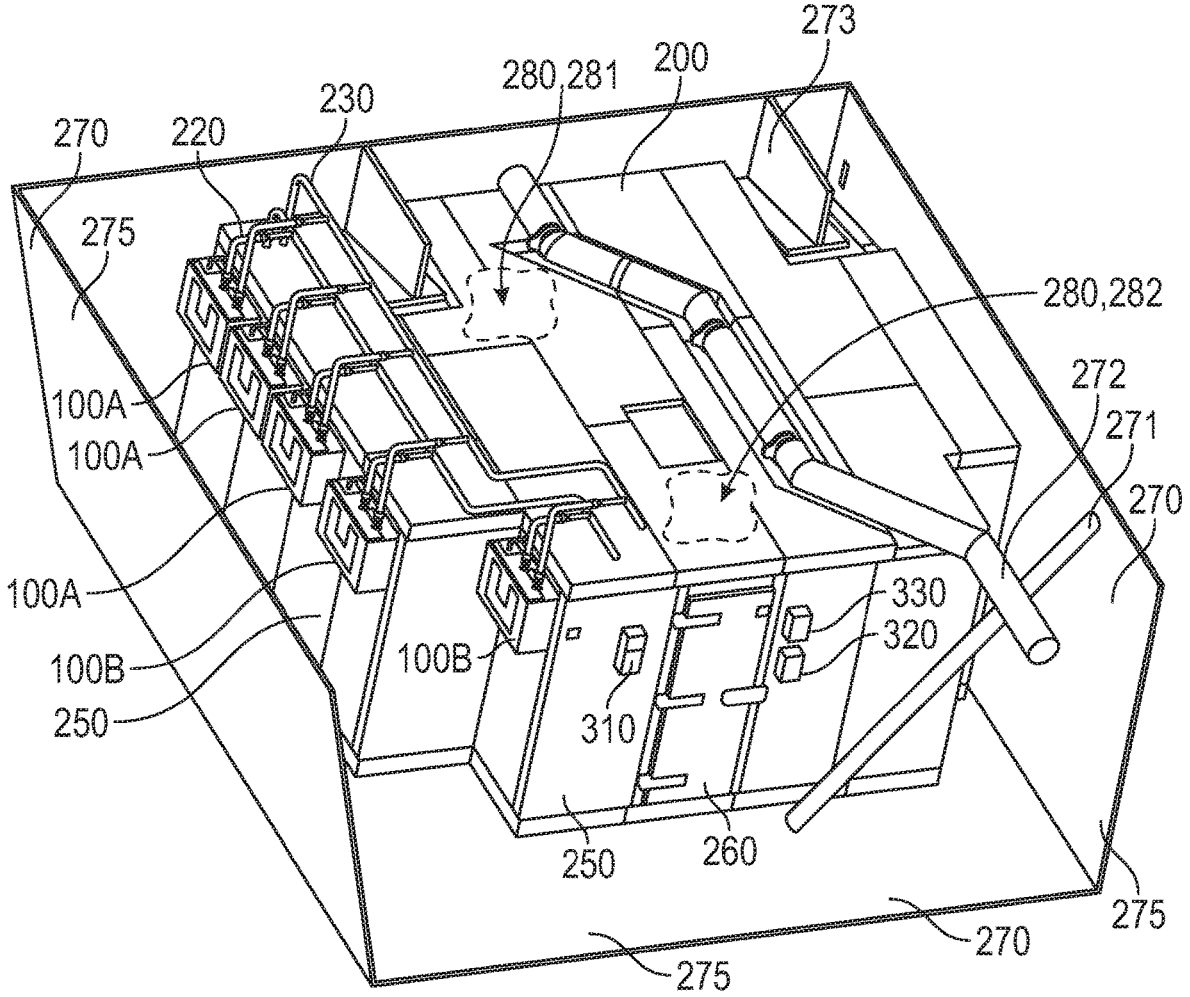
FIG. 2B depicts a perspective view of a modular refrigeration system.
Figure 2C:
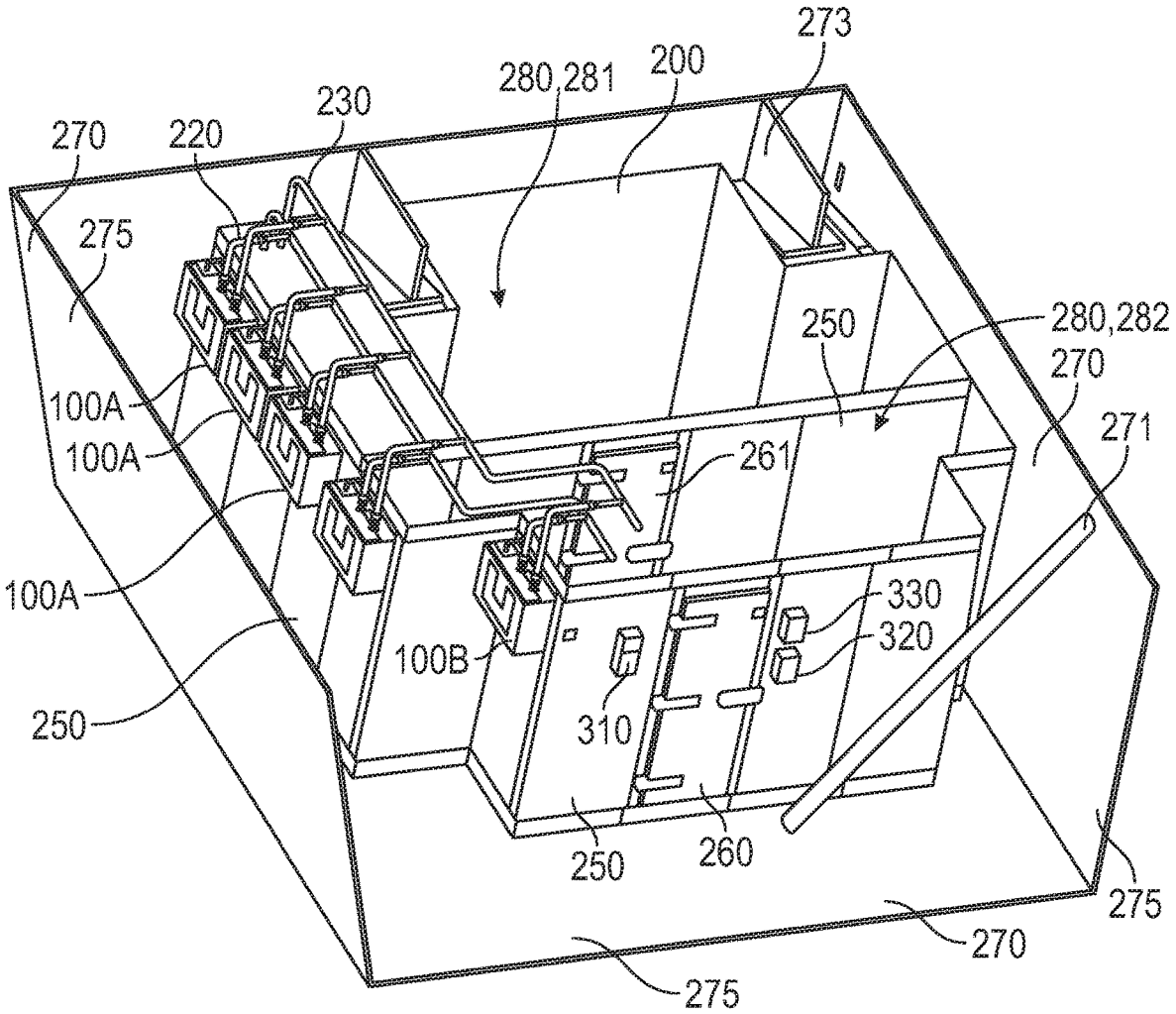
FIG. 2C depicts a perspective view showing the interior of a modular refrigeration system.

FIGS. 2A, 2B, and 2C depict side and perspective views, respectively, of an embodiment of a modular refrigeration system 200 having a plurality of modular refrigeration units 100A operating as part of a freezer system (i.e., as freezing units) and a plurality of modular refrigeration units 100B operating as part of a cooler system (i.e., as cooler/refrigerator units), with FIG. 2C showing more detail about interior space 280. Each modular refrigeration unit 100A and each modular refrigeration unit 100B is a modular refrigeration unit 100, with the mode (freezer/cooler) of each being selected as discussed below the subheading, Selection of Mode of Operation, in the discussion below of FIG. 6.

Modular refrigeration system 200 also comprises communications cable 210, chilled water line 220, chilled water return 230, water collection pipe 240, wall 250, exterior door 260, interior space 280, freezing interior space 281, and refrigerated interior space 282.

Wall 250 is a wall that extends around all sides of modular refrigeration system 200 forming an interior space 280. Wall 250 has openings for insertion of modular refrigeration units 100A operating as part of a freezer system and modular refrigeration units 100B operating as part of a cooler system. When inserted into wall 250, modular refrigeration unit 100A or modular refrigeration unit 100B fits into wall 250 inside seam 950, securely fitting such that chilled air does not leak out of interior space 280. The opening formed at seam 950 may be referred to as a mating aperture. Wall 250 also has an opening for exterior door 260. In certain embodiments, wall 250 is insulated. In the embodiment disclosed in FIGS. 2B and 2C, wall 250 also separates the interior space 280 to form a refrigerated interior space 282 and a freezing interior space 281, with an interior door 261 connecting said refrigerated interior space 282 and said freezing interior space 281. In these embodiments, wall 250 separates areas conditioned by modular refrigeration units 100A operating as part of a freezer system and modular refrigeration units 100B operating as part of a cooler system. The modular refrigeration system 200 is configured to maintain the refrigerated interior space 282 at temperatures suitable for keeping perishable food fresh but not frozen (i.e., between approximately 34 and 42 degrees Fahrenheit, although the temperature is adjustable); and to maintain the freezing interior space 281 at temperatures suitable for keeping perishable food frozen (i.e., below 32 degrees Fahrenheit, in some embodiments, between −5 and 5 degrees Fahrenheit).

Communications cable 210 connects to, or is the same as, communications cable 121, providing the same electrical data connection between freezer control panel 310 (modular refrigeration units 100A) or cooler control panel 320 (modular refrigeration units 100B).

In operation, chilled water flows through chilled water line 220, and this chilled water flows into each modular refrigeration unit 100A and each modular refrigeration unit 100B and is used to cool heated compressed refrigerant 185 as part of a refrigeration cycle. The chilled water then flows out of each modular refrigeration unit 100A and each modular refrigeration unit 100B through chilled water return 230.

Chilled water line 220 connects, via quick connect fitting, to the chilled water inlet 130 of each of modular refrigeration unit 100A and each modular refrigeration unit 100B. Chilled water return 230 connects, via quick connect fitting, to the chilled water outlet 135 of each modular refrigeration unit 100A and each modular refrigeration unit 100B. Water collection pipe 240 connects to a drain on each modular refrigeration unit 100A and each modular refrigeration unit 1008. Water collection pipe 240 provides a drain for condensation collected in a drip pan beneath the evaporator 150. Use of quick connect fittings helps decrease the time required to replace a modular refrigeration unit 100 of modular refrigeration system 200, helping to provide the advantages discussed below.

Modular refrigeration system 200 also comprises, in certain embodiments, freezer control panel 310, cooler control panel 320, and man trapped alarm panel 330, which are located on wall 250 in an easily-accessible location and which are discussed in more detail in reference to FIGS. 3A, 3B, 5, 6, and 7.

In the exemplary embodiment depicted in FIGS. 2B and 2C, modular refrigeration system 200 is installed on a maritime vessel. FIGS. 2B and 2C depict a portion of a maritime vessel 275, along with ship wall 270, ship structure 271, ship duct 272, and ship beam 273, each of which are components of maritime vessel 275 and not components of modular refrigeration system 200. Modular refrigeration system 200 may be designed to accommodate irregular shapes as necessitated by particular space available for installation (and as shown, modular refrigeration system 200 is designed to accommodate ship wall 270, ship structure 271, ship duct 272, and ship beam 273).

As may be understood from the foregoing description and the figures, modular refrigeration system 200 may be assembled in-place (piece-by-piece) on maritime vessel 275 or in other intended offshore, maritime, or military, or other hazardous environments (including, without limitation, combat vessels, non-combatant military vessels, oil exploration vessels, oil rigs, oil production platforms, and cruise ships).

Because all of the modular refrigeration units 100 are interchangeable (regardless of whether a modular refrigeration unit 100A or a modular refrigeration unit 1008), a user can replace any modular refrigeration unit 100 of modular refrigeration system 200 with a spare modular refrigeration unit 100, which may be stored exterior to modular refrigeration system 200. In the event that any modular refrigeration unit 100 breaks, fails, becomes damaged, or otherwise becomes inoperable (such as, but not limited to, a bomb, torpedo, explosion, or other casualty occurring in the place in which modular refrigeration system 200 is installed), the broken modular refrigeration unit 100 can be quickly removed and a spare modular refrigeration unit 100 can be quickly installed. Thus, modular refrigeration system 200 can become fully functional without the need to fix a broken, inoperable, or damaged modular refrigeration unit 100 (which broken, inoperable, or damaged modular refrigeration unit 100 can be repaired at a convenient time and location). In certain environments, such as offshore, military, or other hazardous environments, but not limited thereto, we speculate that it is desirable to have a modular refrigeration system 200 that can be quickly repaired without the need for an on-site technician and without the need for special tools or any tools.

Figure 3A:
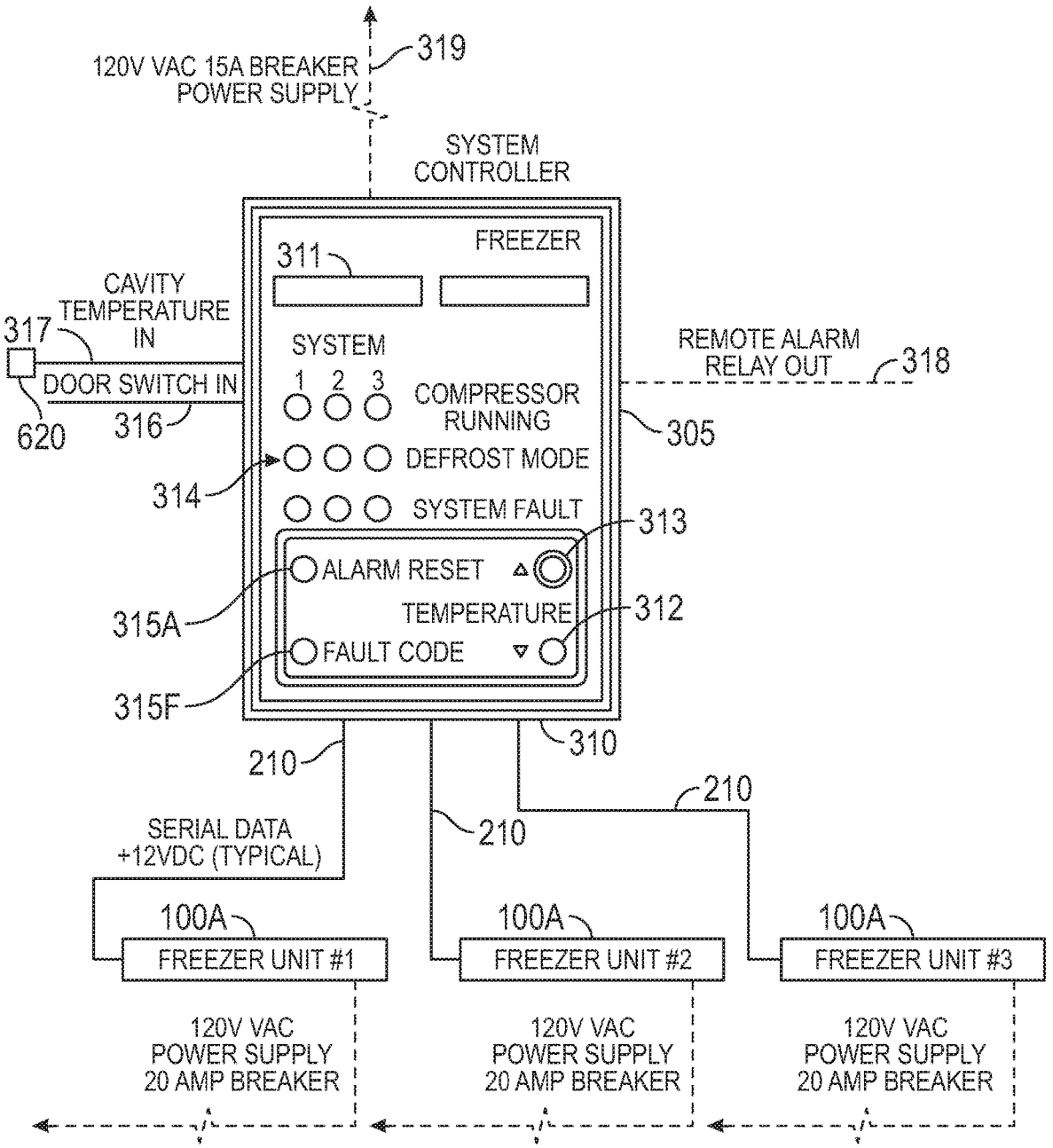
FIG. 3A depicts a side view of a freezer control panel and an associated block diagram of electrical connections thereto.

FIG. 3A depicts freezer control panel 310. Freezer control panel 310 is an example of a control panel 305. In this embodiment, freezer control panel 310 is connected to a plurality of modular refrigeration units 100A configured as part of a freezer system. Freezer control panel 310 contains freezer panel PCB 610 (shown in FIG. 6), which coordinates control of modular refrigeration units 100A, directs the display of information on freezer alphanumeric display 311 and freezer operating indicators 314, and receives user input from freezer temperature increase button 313, freezer temperature decrease button 312, freezer alarm reset button 315A, and freezer fault display button 315F. In one embodiment, freezer alphanumeric display 311 displays the desired interior temperature. In other embodiments, freezer alphanumeric display 311 displays both the desired interior temperature and the current interior temperature. Freezer control panel 310 receives power via freezer panel power cable 319. Freezer control panel 310 also receives temperature input from a freezer thermometer 620 located inside the freezing interior space 281 by way of freezer cavity temperature cable 317. Freezer control panel 310 also receives input regarding whether exterior door 260 is open or closed by way of freezer door switch cable 316. In some embodiments, freezer control panel 310 may cause a visual or auditory alarm when exterior door 260 is open for more than a predetermined amount of time (e.g., 20 minutes). In some embodiments, freezer operating indicators 314 indicate, for each modular refrigeration unit 100A, whether said unit's compressor is running, whether said unit is in defrost mode, and whether that unit has a system fault. In some embodiments, freezer alarm reset button 315A accepts input to reset alarm conditions, and freezer fault display button 315F accepts input to cause a fault code to be displayed on freezer alphanumeric display 311. System fault codes or other alarm information may be transmitted out of freezer control panel 310 by way of freezer alarm cable 318. In some embodiments, freezer alarm cable 318 directly controls an exterior alarm.

Figure 3B:
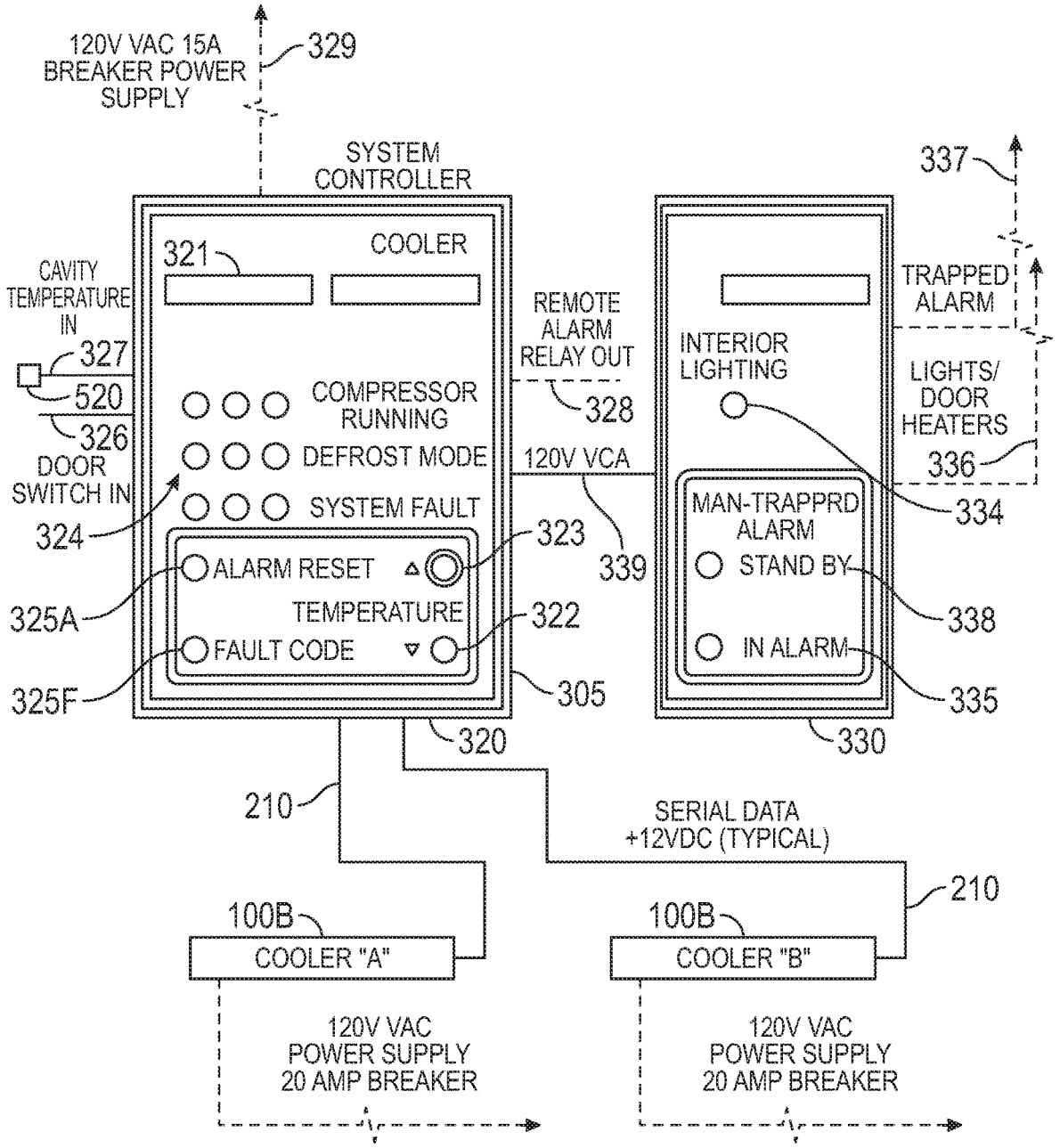
FIG. 3B depicts side views of a cooler control panel and a man trapped alarm panel and associated block diagrams of electrical connections thereto.

FIG. 3B depicts cooler control panel 320 and man trapped alarm panel 330. Cooler control panel 320 is an example of a control panel 305. In this embodiment, cooler control panel 320 is connected to a plurality of modular refrigeration units 100B configured as part of a cooler system. Cooler control panel 320 contains cooler panel PCB 510 (shown in FIG. 5), which coordinates control of modular refrigeration units 100B, directs the display of information on cooler alphanumeric display 321 and cooler operating indicators 324, and receives user input from cooler temperature increase button 323, cooler temperature decrease button 322, cooler alarm reset button 325A, and cooler fault display button 325F. In one embodiment, cooler alphanumeric display 321 displays the desired interior temperature. In other embodiments, cooler alphanumeric display 321 displays both the desired interior temperature and the current interior temperature. Cooler control panel 320 receives power via cooler panel power cable 329. Cooler control panel 320 also receives temperature input from a cooler thermometer 520 located inside the refrigerated interior space 282 by way of cooler cavity temperature cable 327. Cooler control panel 320 also receives input regarding whether exterior door 260 is open or closed by way of cooler door switch cable 326. In some embodiments, cooler control panel 320 may cause a visual or auditory alarm when exterior door 260 is open for more than a predetermined amount of time (e.g., 20 minutes). In some embodiments, cooler operating indicators 324 indicate, for each modular refrigeration unit 1008, whether said unit's compressor is running, whether said unit is in defrost mode, and whether that unit has a system fault. In some embodiments, cooler alarm reset button 325A accepts input to reset alarm conditions, and cooler fault display button 325F accepts input to cause a fault code to be displayed on cooler alphanumeric display 321. System fault codes or other alarm information may be transmitted out of cooler control panel 320 by way of cooler alarm cable 328. In some embodiments, cooler alarm cable 328 directly controls an exterior alarm.

Figure 7:
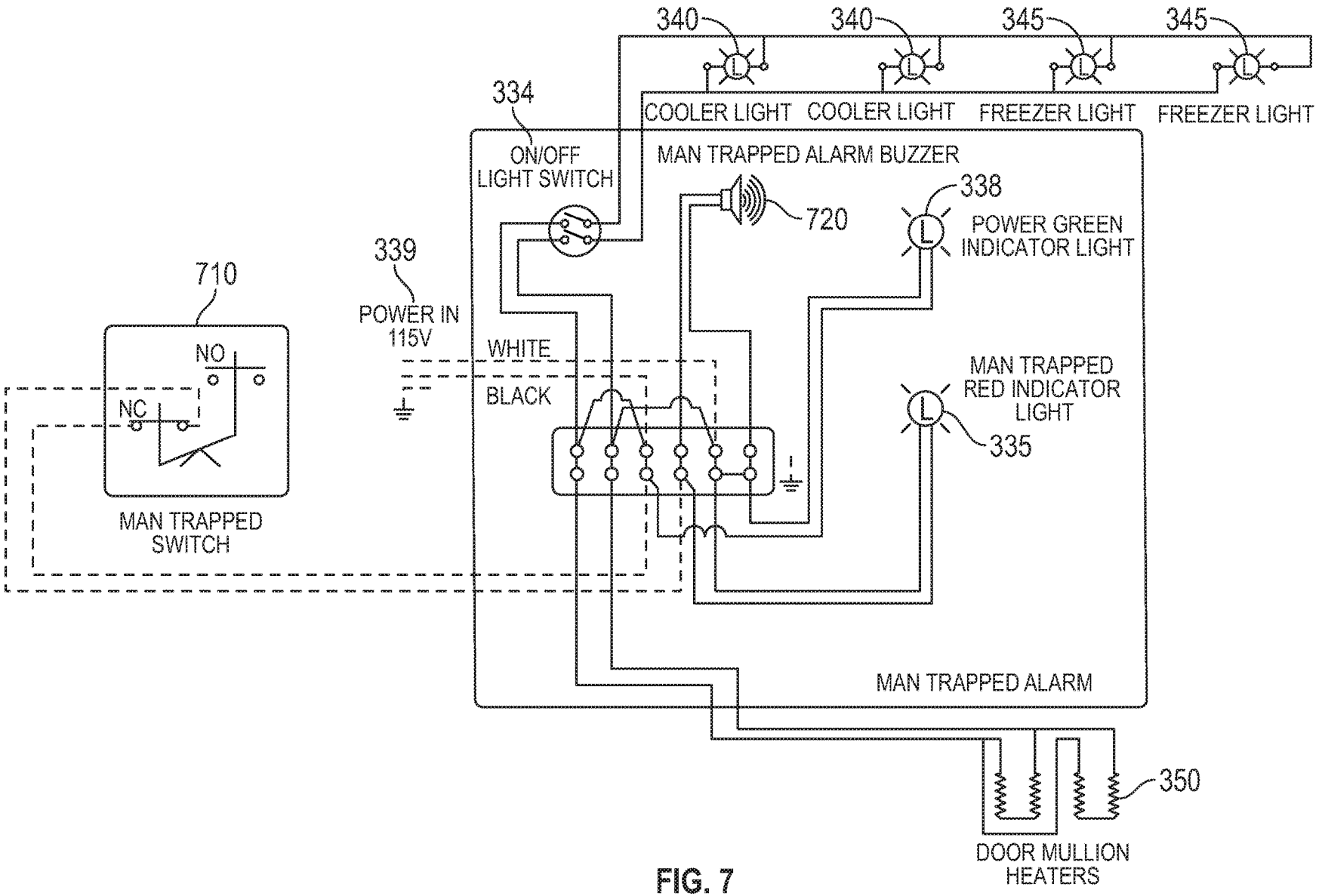
FIG. 7 depicts a wiring diagram for a man trapped alarm panel.

Man trapped alarm panel 330 comprises interior lighting switch 334, alarm indicator 335, man trapped output cable 336, man trapped alarm cable 337, power indicator 338, and man trapped panel power cable 339, and man trapped switch 710 (located on a wall 250 of interior space 280, and shown in FIG. 7). Man trapped alarm panel also provides a power connection to mullion heaters 350 (shown in FIG. 7) for exterior door 260 and seam 950. Connections between elements of man trapped alarm panel 330 are depicted and discussed in reference to FIG. 7.

Man trapped alarm panel 330 provides a safety feature allowing a person trapped inside interior space 280 to cause an alarm outside modular refrigeration system 200 when that person presses man trapped switch 710. In one embodiment, the alarm comprises is buzzer 720 and alarm indicator 335, but other types of alarms, or combinations thereof, may be used (e.g., light, sound, vibration, or otherwise). In some embodiments, interior lighting is also turned on when man trapped switch 710 is engaged.

Interior lighting switch 334 toggles the state of one or more interior cooler lights 340 and interior freezer lights 345, which are present inside refrigerated interior space 282 and freezing interior space 281, respectively. Alarm indicator 335 indicates when man trapped switch 710 is engaged; and, in one embodiment, alarm indicator 335 is a light. Power indicator 338 indicates when man trapped alarm panel 330 is receiving power.

In certain embodiments, interior lighting is engaged by means of man trapped output cable 336 in response to user input into man trapped alarm panel 330. Alarm state may be transmitted out of man trapped alarm panel 330 by way of man trapped alarm cable 337. In some embodiments, man trapped alarm cable 337 directly controls an exterior alarm.

FIGS. 4A and 4B depict a wiring diagram of a modular refrigeration unit 100, showing the electrical connections between components of modular refrigeration unit 100. Shown on FIGS. 4A and 4B are operation indicators 106, operation switch 107, axial fans 110, communications cable 121, compressor 153, electronic expansion valve 155, electronic super heat control 156, fluid flow switch 161, liquid line solenoid valve 166, hot gas solenoid valve 169, water valve 171, unit PCB 410, unit power supply 420, unit thermometer 430, and evaporator thermometer 440.

Unit power supply 420 receives electrical power in alternating current provided to unit PCB 410 through input power socket 120, converts that power to direct current, and provides direct current power to unit PCB 410. Through electrical connections displayed in FIGS. 4A and 4B, unit PCB 410 controls the activity of, or receives input control from, operation indicators 106, operation switch 107, axial fans 110, compressor 153, electronic super heat control 156, fluid flow switch 161, liquid line solenoid valve 166, hot gas solenoid valve 169, and water valve 171. Electronic expansion valve 155 receives input control through its electrical connection with electronic super heat control 156. In some embodiments, the electrical connection between electronic super heat control 156 and unit PCB 410 is capable of sending and receiving data. In some embodiments, this data can be used for system diagnostics.

Unit thermometer 430 is a thermometer electrically connected to unit PCB 410 and located so that unit thermometer 430 detects the temperature of interior space 280 (for a unit thermometer 430 which is part of a modular refrigeration unit 100A operating as part of a freezer system, unit thermometer 430 detects the temperature of freezing interior space 281, and for a unit thermometer 430 which is part of a modular refrigeration unit 100B operating as part of a cooler system, unit thermometer 430 detects the temperature of refrigerated interior space 282).

Evaporator thermometer 440 is a thermometer electrically connected to unit PCB 410 and located so that evaporator thermometer 440 detects the temperature of evaporator 150.

Figure 5:
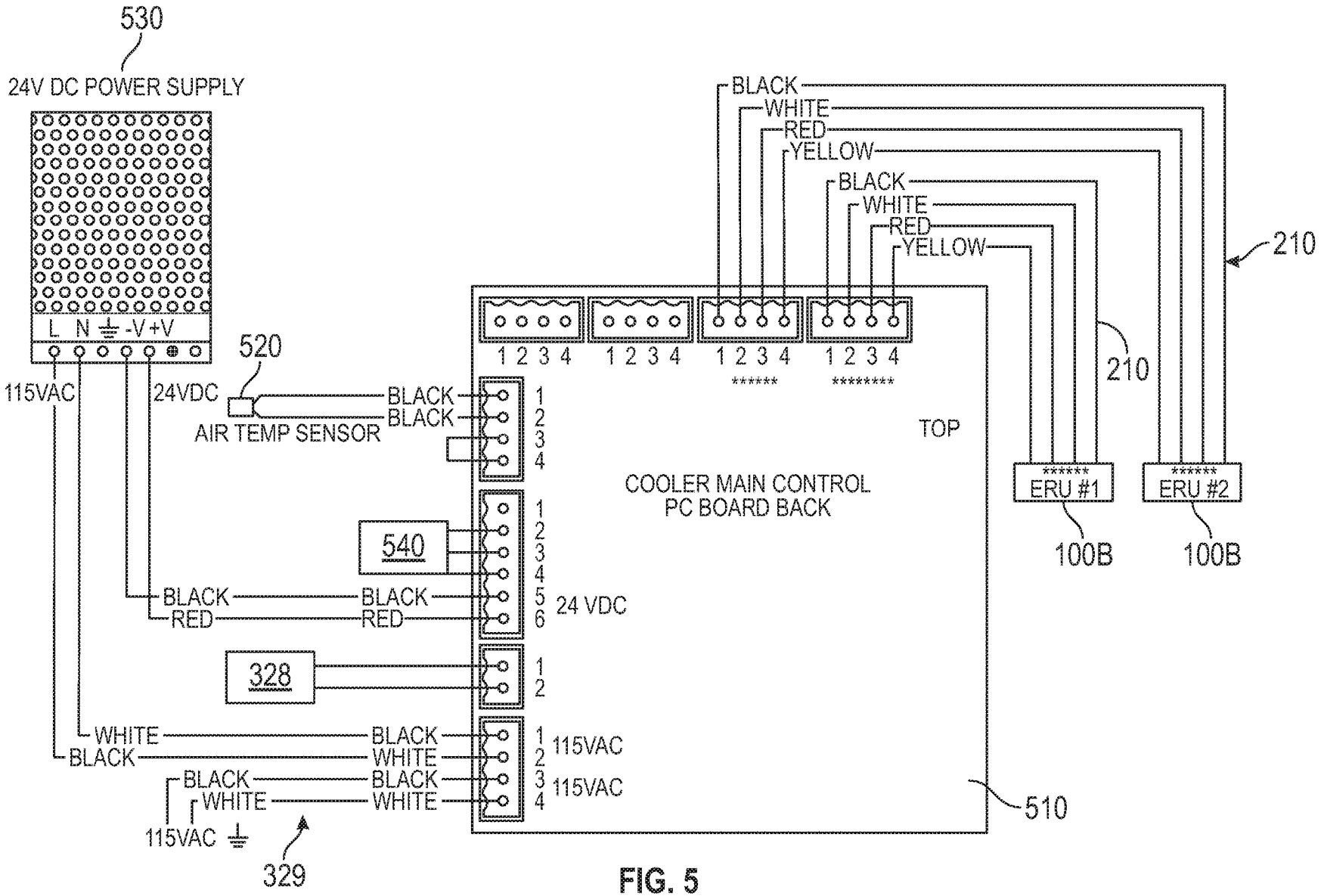
FIG. 5 depicts a wiring diagram for a cooler control panel.

FIG. 5 depicts a wiring diagram for an embodiment of cooler control panel 320. In addition to other components discussed above, cooler control panel 320 comprises cooler panel PCB 510, cooler thermometer 520, and cooler battery 530. Also shown in FIG. 5 are cooler panel power cable 329, providing power to cooler panel PCB 510, and communications cables 210 connected to a plurality of modular refrigeration units 100B.

In some embodiments, cooler panel PCB 510 is a printed circuit board containing one or more logic chips, including, without limitation, application specific integrated circuits (ASICs), field programmable gate arrays (FPGAs), microcontrollers, microprocessors, or other electrical components capable of directing the control of components as discussed herein.

Cooler thermometer 520 is a thermometer and is located inside refrigerated interior space 282, but is electrically connected to cooler panel PCB 510 and provides cooler panel PCB 510 with the temperature of air inside refrigerated interior space 282. Cooler battery 530 is a rechargeable battery capable of accepting alternating current power (in one embodiment, 115 VAC) and providing direct current power (in one embodiment, 24 VDC). Cooler battery 530 provides power to cooler panel PCB 510 in the event that power from cooler panel power cable 329 is interrupted. In this one embodiment, each communications cable 210 is comprised of four wires, each colored black, white, red, or yellow.

Figure 6:
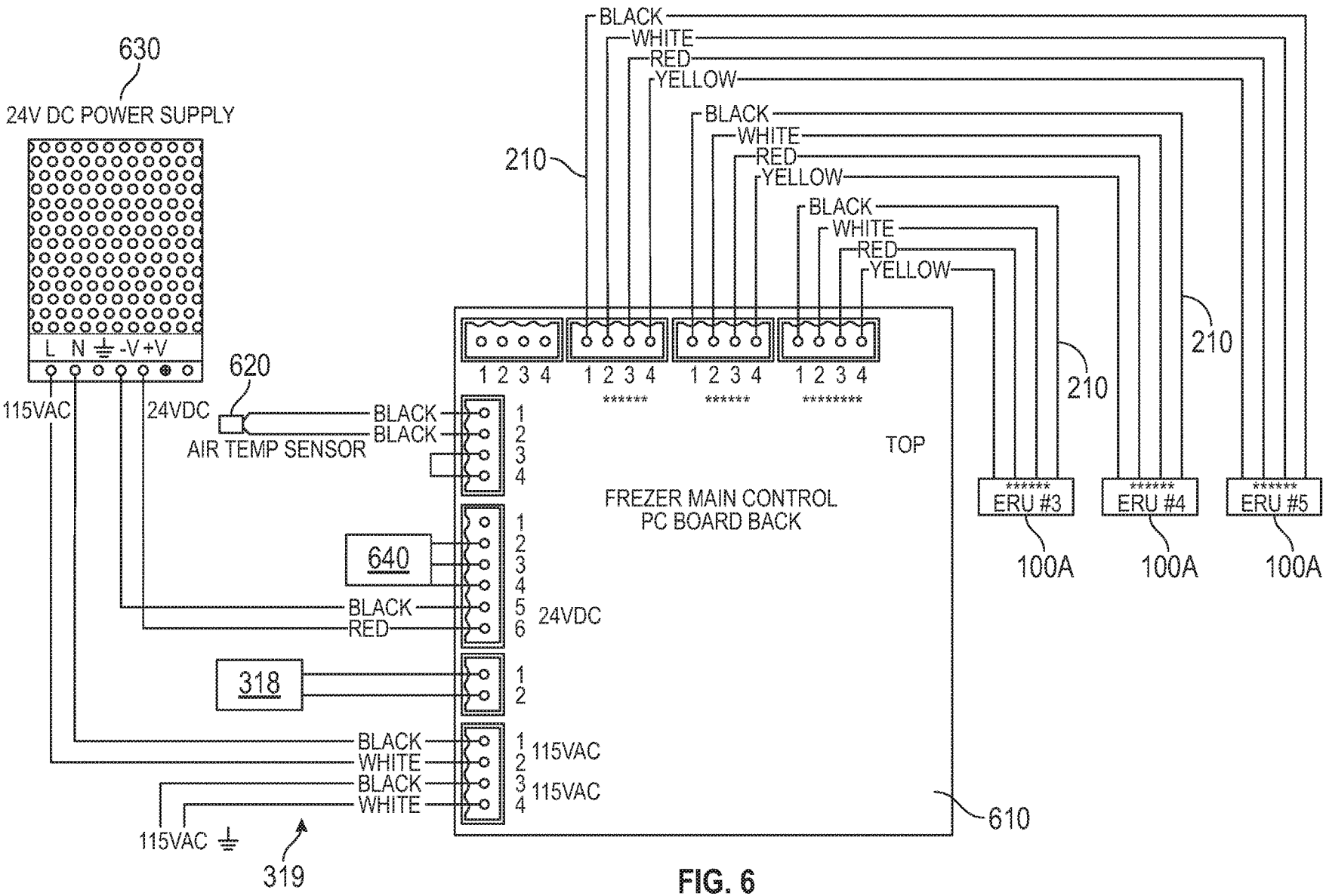
FIG. 6 depicts a wiring diagram for a freezer control panel.

FIG. 6 depicts a wiring diagram for freezer control panel 310. In addition to other components discussed above, freezer control panel 310 comprises freezer panel PCB 610, freezer thermometer 620, and freezer battery 630. Also shown in FIG. 6 are freezer panel power cable 319, providing power to freezer panel PCB 610, and communications cables 210 connected to a plurality of modular refrigeration units 100A.

In some embodiments, freezer panel PCB 610 is a printed circuit board containing one or more logic chips, including, without limitation, application specific integrated circuits (ASICs), field programmable gate arrays (FPGAs), microcontrollers, microprocessors, or other electrical components capable of directing the control of components as discussed herein.

Freezer thermometer 620 is a thermometer and is located inside freezing interior space 281, but is electrically connected to freezer panel PCB 610 and provides freezer panel PCB 610 with the temperature of air inside freezing interior space 281. Freezer battery 630 is a rechargeable battery capable of accepting alternating current power (in one embodiment, 115 VAC) and providing direct current power (in one embodiment, 24 VDC). Freezer battery 630 provides power to freezer panel PCB 610 in the event that power from freezer panel power cable 319 is interrupted. In this one embodiment, each communications cable 210 is comprised of four wires, each colored black, white, red, or yellow.

Selection of Mode of Operation

The same modular refrigeration unit 100 may be used as part of a freezer system or a cooler system. In some embodiments, unit PCB 410 contains a switch for selecting the desired mode. FIG. 5 shows cooler jumper 540 connected to cooler panel PCB 510 and FIG. 6 shows freezer jumper 640 connected to freezer panel 610. In the depicted embodiment, cooler jumper 540 and freezer jumper 640 are used to select the desired mode and to select the number of modular refrigeration units 100 connected. In other embodiments, unit PCB 410 receives instruction about desired mode from a control panel 305. Thus, in such an embodiment, if modular refrigeration unit 100 is connected to freezer control panel 310, unit PCB 410 receives instruction via communications cable 121 from freezer panel PCB 610 to operate in a freezer mode. Alternatively, if modular refrigeration unit 100 is connected to cooler control panel 320, unit PCB 410 receives instruction via communications cable 121 from cooler panel PCB 510 to operate in a cooler mode. Thus, because the same modular refrigeration unit 100 can be connected to ether a freezer control panel 310 or a cooler control panel 320, modular refrigeration units 100 are interchangeable. In some embodiments, freezer panel PCB 610 and cooler panel PCB 510 may contain a switch to selecting the desired mode of operation for any connected modular refrigeration units 100. We speculate that a modular refrigeration unit 100 capable of operating as either part of a freezer system or as part of a cooler system allows operational advantages, namely, the ability to stock fewer replacement units while maintaining the same expected operational availability and/or higher expected availability with the same number of stocked replacement units.

Synchronous Operation

As discussed herein, a plurality of modular refrigeration units 100 (e.g., modular refrigeration units 100A operating in freezer mode or modular refrigeration units 100B operating in cooler mode) may be connected to a control panel 305 (e.g., cooler control panel 320 or freezer control panel 310). Modular refrigeration system 200 causes this plurality of modular refrigeration units 100 to operate synchronously. In other words, all of the plurality of modular refrigeration units 100 start and stop cooling mode on or about the same time, and the entry of each of the plurality of modular refrigeration units 100 into defrost mode is scheduled so that the entry of one or more modular refrigeration units 100 into defrost mode does not overly diminish the cooling capacity of the plurality of modular refrigeration units 100. In some embodiments, this means that no more than one modular refrigeration unit 100 of the plurality of modular refrigeration units 100 enters defrost mode at the same time.

Under normal operation, the plurality of modular refrigeration units 100 are all in communication with a control panel 305. In this state, the plurality of modular refrigeration units 100 collectively enter cooling mode in response to input from a thermometer connected to a control panel 305 to maintain a desired temperature of interior space 280 (e.g., freezer thermometer 620 connected to freezer panel PCB 610 for modular refrigeration units 100 connected to freezer controller panel 310 and operating as part of a freezer system to maintain a user-set temperature of freezing interior space 281, or cooler thermometer 520 connected to cooler panel PCB 510 for modular refrigeration units 100 connected to cooler controller panel 320 and operating as part of a cooler system to maintain a user-set temperature of refrigerated interior space 282). However, when communications are severed (whether intentionally or inadvertently, such as due to an accident, explosion, or other catastrophic or like incident), modular refrigeration system 200 maintains operations because each of said plurality of modular refrigeration units 100 operates independently.

When operating independently (communications severed), modular refrigeration unit 100 enters cooling mode in response to input from unit thermometer 430. In some embodiments, modular refrigeration unit 100 maintains the previously user-set temperature of interior space 280, where the user-set temperature is set by input from freezer control panel 310 or cooler control panel 320, respectively, and where unit PCB 410 stores the user-set temperature in memory so that the user-set temperature can be maintained when communications are severed. In other embodiments, when operating independently, modular refrigeration unit 100 enters cooling mode in response to input from unit thermometer 430 to maintain a predetermined temperature based on whether modular refrigeration unit 100 is operating as a freezer or as a refrigerator. Where modular refrigeration unit 100 is operating as a freezer, the predetermined temperature is 0 degrees Fahrenheit. Where modular refrigeration unit 100 is operating as a refrigeration, the predetermined temperature is 38 degrees Fahrenheit.

Under normal operation, when modular refrigeration unit 100 is in communications with a control panel 305 (e.g., freezer controller panel 310 or cooler controller panel 320), unit PCB 410 only causes modular refrigeration unit 100 to enter defrost mode upon receiving instruction from a control panel 305 to do so.

However, when operating independently (communications severed), modular refrigeration unit 100 enters defrost mode on a predetermined schedule. Unit PCB 410 determines the amount of time that has elapsed since the last time modular refrigeration unit 100 has entered defrost mode. If enough time has elapsed, unit PCB 410 causes modular refrigeration unit 100 to enter defrost mode.

Because modular refrigeration system 200 staggers the entry into defrost mode of modular refrigeration units 100 when communications are not severed, maintaining a fixed amount of time between entry into defrost mode will ensure that modular refrigeration units 100 continue to stagger entry into defrost mode when communications are severed.

In one embodiment, the respective control panel 305 (e.g., cooler control panel 320 or freezer control panel 310) causes the synchronous operation discussed above by sending commands from freezer panel PCB 610 or cooler panel PCB 510, respectively, through a respective communication cable 121, to each associated unit PCB 410. In this mode control is maintained by logic (whether hardware, software, or a combination of hardware and software) running on freezer panel PCB 610 or cooler panel PCB 510, respectively.

In other embodiments, freezer panel PCB 610 or cooler panel PCB 510, respectively, take a more limited role and simply pass commands and information between the modular refrigeration units 100. In these embodiments, all operations logic is maintained in unit PCB 410, and the plurality of connected modular refrigeration units 100 work collaboratively to coordinate control. In some embodiments, modular refrigeration units 100 will operate in a master/slave configuration, with one modular refrigeration unit 100 directing control of the one or more other modular refrigeration units 100.

FIG. 7 depicts a wiring diagram for a man trapped alarm panel 330, showing electrical connections between interior lighting switch 334, alarm indicator 335, power indicator 338, man trapped panel power cable 339, interior cooler lights 340, interior freezer lights 345, mullion heater 350 (for exterior door 260 or seam 950), and man trapped switch 710. These electrical connections allow for functions described herein.

Figure 8:
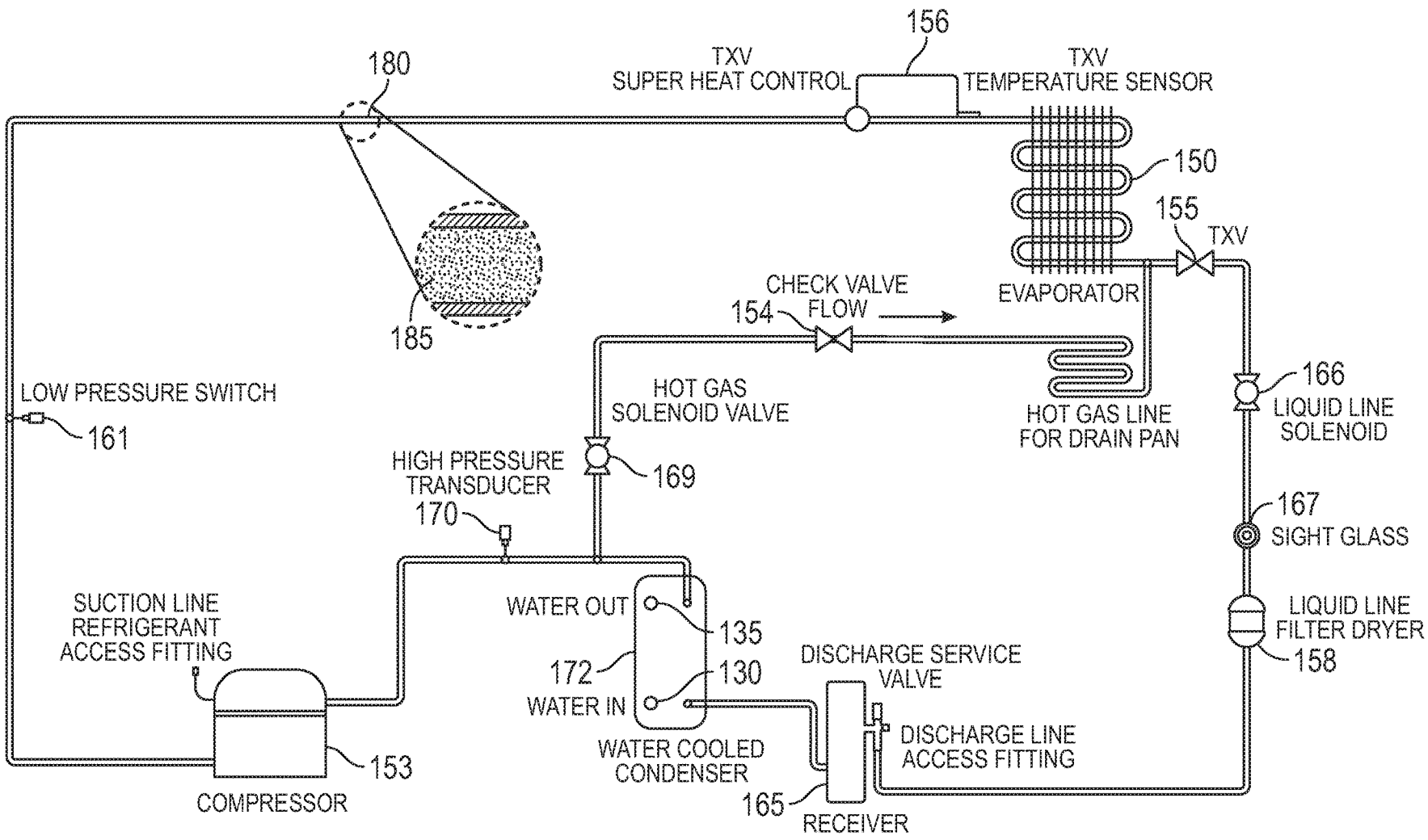
FIG. 8 depicts a fluid component diagram for a modular refrigeration unit.

FIG. 8 depicts a component diagram for a modular refrigeration unit 100, showing evaporator 150, compressor 153, refrigeration check valve 154, electronic expansion valve 155, electronic super heat control 156, filter dryer 158, fluid flow switch 161, receiver 165, liquid line solenoid valve 166, sight glass 167, hot gas solenoid valve 169, pressure transducer 170, and heat exchanger 172, which are all located in modular refrigeration unit 100 and which are also connected by piping 180 as shown in FIG. 8. Piping 180 shown in FIG. 8 carry refrigerant 185 to other components of modular refrigeration unit 100 as indicated in FIG. 8. In one embodiment, the refrigerant 185 is R404a.

Described herein are both a cooling mode, wherein cool refrigerant 185 passes through evaporator 150 allowing exterior air to become cooler as it passes across evaporator 150, and a defrost mode, wherein warm refrigerant 185 passes through evaporator 150 and through drain pan line to defrost the exterior of those components. When modular refrigeration unit 100 is in a cooling mode, unit PCB 410 causes liquid line solenoid valve 166 to open and hot gas solenoid valve 169 to close.

FIG. 8 depicts a loop, so the starting point of this description is for instruction only. In cooling mode, first, refrigerant 185 flows to compressor 153 across fluid flow switch 161. If unit PCB 410 detects refrigerant 185 pressure is low from fluid flow switch 161, unit PCB 410 causes compressor 153 to engage. Refrigerant 185 then flows through piping across pressure transducer 170 to heat exchanger 172 (in cooling mode, hot gas solenoid valve 169 is closed, and refrigerant 185 only flows to heat exchanger 172). Heated refrigerant 185 flows through heat exchanger 172 and is cooled.

Unit PCB 410 regulates the opening of water valve 171 in view of information received from pressure transducer 170. In one embodiment, unit PCB 410 closes water valve 171 when unit PCB is not receiving power, opens water valve 171 one quarter when pressure transducer 170 detects pressure below 200 psi, opens water valve 171 one half when pressure transducer 170 detects pressure of 250 psi, and opens water valve 171 to be fully open when pressure transducer 170 detects pressure of 325 psi or greater. Water valve 171 regulates the flow of chilled water in and out of heat exchanger 172, as received into modular refrigeration unit 100 through chilled water inlet 130 and as flowing out of modular refrigeration unit 100 through chilled water outlet 135. As an interior space 280 becomes cooler, evaporator 150 becomes cooler, and the refrigerant 185 is lower pressure at pressure transducer 170. As this pressure lowers, pressure transducer 170 directs water valve 171 to allow less chilled water into heat exchanger 172, thereby cooling the refrigerant 185 less. Likewise, if interior space 280 becomes warmer, evaporator 150 becomes warmer, and the refrigerant 185 is higher pressure at pressure transducer 170. As this pressure increases, pressure transducer 170 directs water valve 171 to allow more chilled water into heat exchanger 172, thereby cooling the refrigerant 185 more.

After flowing out of heat exchanger 172, refrigerant 185 flows into receiver 165, which is a tank or reservoir where refrigerant 185 further cools, after which cooled refrigerant 185 flows to filter dryer 158. Filter dryer 158 is a line filter. Refrigerant 185 then flows to sight glass 167. Sight glass allows for visual inspection of refrigerant 185. Then, refrigerant 185 flows across liquid line solenoid valve 166 to electronic expansion valve 155, then through evaporator 150, past electronic super heat control 156, to fluid flow switch 161. Electronic expansion valve 155 and electronic super heat control 156 work together to regulate flow of refrigerant 185 through evaporator 150. Electronic super heat control 156 includes a thermometer which detects the temperature of refrigerant 185. Warmer refrigerant 185 causes electronic expansion valve 155 to allow the flow of more refrigerant 185.

In one embodiment, electronic super heat control 156 and electronic expansion valve 155 are digital components. We speculate that this allows for more precise control of refrigerant 185 flow and more efficient operation.

Unit PCB 410 engages cooling mode in response to desired temperature of interior space 280 as discussed above. When unit PCB 410 engages cooling mode, refrigerant 185 flows as discussed above. Additionally, when cooling mode is engaged and evaporator thermometer 440 detects temperatures at or below a predetermined temperature, unit PCB 410 engages axial fans 110, thereby causing air to blow across, and become cooled by, evaporator 150, resulting in a decrease in temperature of interior space 280. This operation is discussed in more detail below in relation to evaporator temperature checking step 1693, fan engaging step 1695, and fan disengaging step 1697 of cooling operations method 1600.

The foregoing describes operation of modular refrigeration unit 100 in regular cooling mode.

When modular refrigeration unit 100 is in a defrost mode, unit PCB 410 causes liquid line solenoid valve 166 to close and hot gas solenoid valve 169 to open. In this mode, refrigerant 185 does not flow through heat exchanger 172. Rather warm refrigerant 185 flows across refrigeration check valve 154, which is a one-way valve, which prevents backflow of cool refrigerant 185 in cooling mode, through the hot gas line for drain pan, through evaporator 150, back to compressor 153.

Figure 9A:
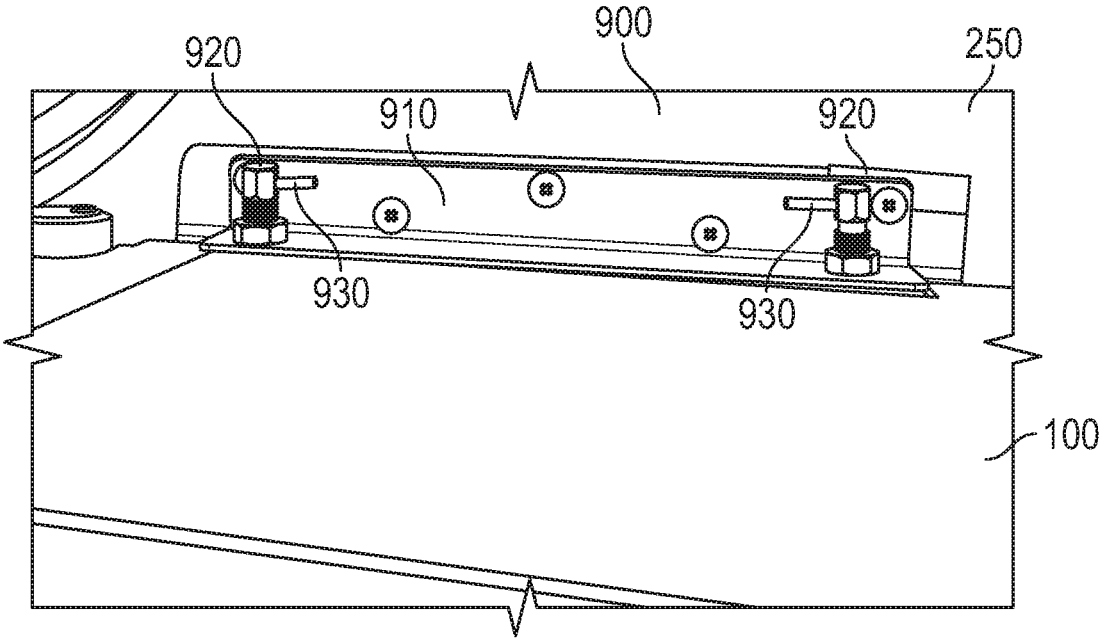
FIGS. 9A and 9B depict a quick release for a modular refrigeration unit.
Figure 9B:
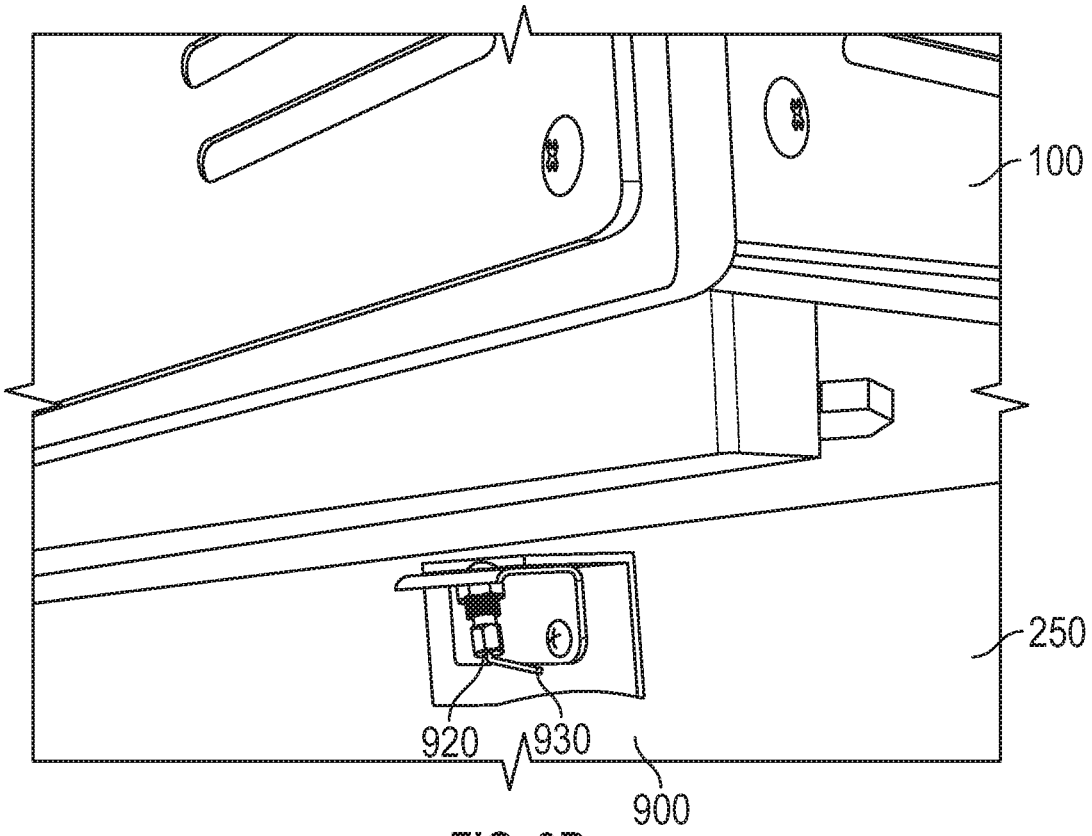

FIGS. 9A and 9B depict the quick release capabilities of modular refrigeration unit 100 with respect to modular refrigeration system 200. In some embodiments, there are two quick release sockets 920 on top of modular refrigeration unit 100 and one quick release socket on the bottom. However, other configurations may be used.

FIG. 9A depicts a close-up perspective view of the quick release system 900, on top of modular refrigeration unit 100. Shown here are showing mounting bracket 910, quick release sockets 920, and quick release pins 930. Mounting bracket 910 is affixed to wall 250, quick release sockets 920 are affixed to mounting bracket 910, and quick release pins 930 are rotatably and slidably connected to an interior hole of quick release sockets 920.

FIG. 9B depicts a close-up perspective view of the quick release system 900 on the bottom of modular refrigeration unit 100. Shown here is one mounting bracket 910 with one quick release socket 920 and one quick release pin 930.

When engaged, quick release pins 930 extend below mounting bracket 910 into a receiving quick release hole in modular refrigeration unit 100, securing modular refrigeration unit 100 in place with respect to wall 250. When disengaged, quick release pins 930 recede into quick release socket 920, allowing modular refrigeration unit 100 to be removed (see FIG. 10). Quick release pins 930 can be engaged or disengaged without the use of tools. More specifically, in the depicted embodiment, quick release pins 930 can be pushed by hand, away from modular refrigeration unit 100, to disengage. Alternatively, quick release pins 930 can be pushed, by hand, towards modular refrigeration unit 100, to engage. Quick release socket 920 is designed to discourage inadvertent engagement or disengagement of quick release pins 930. In some embodiments, quick release pins 930 can be rotated within quick release socket 920 when disengaged to prevent inadvertent re-engagement.

Figure 10:
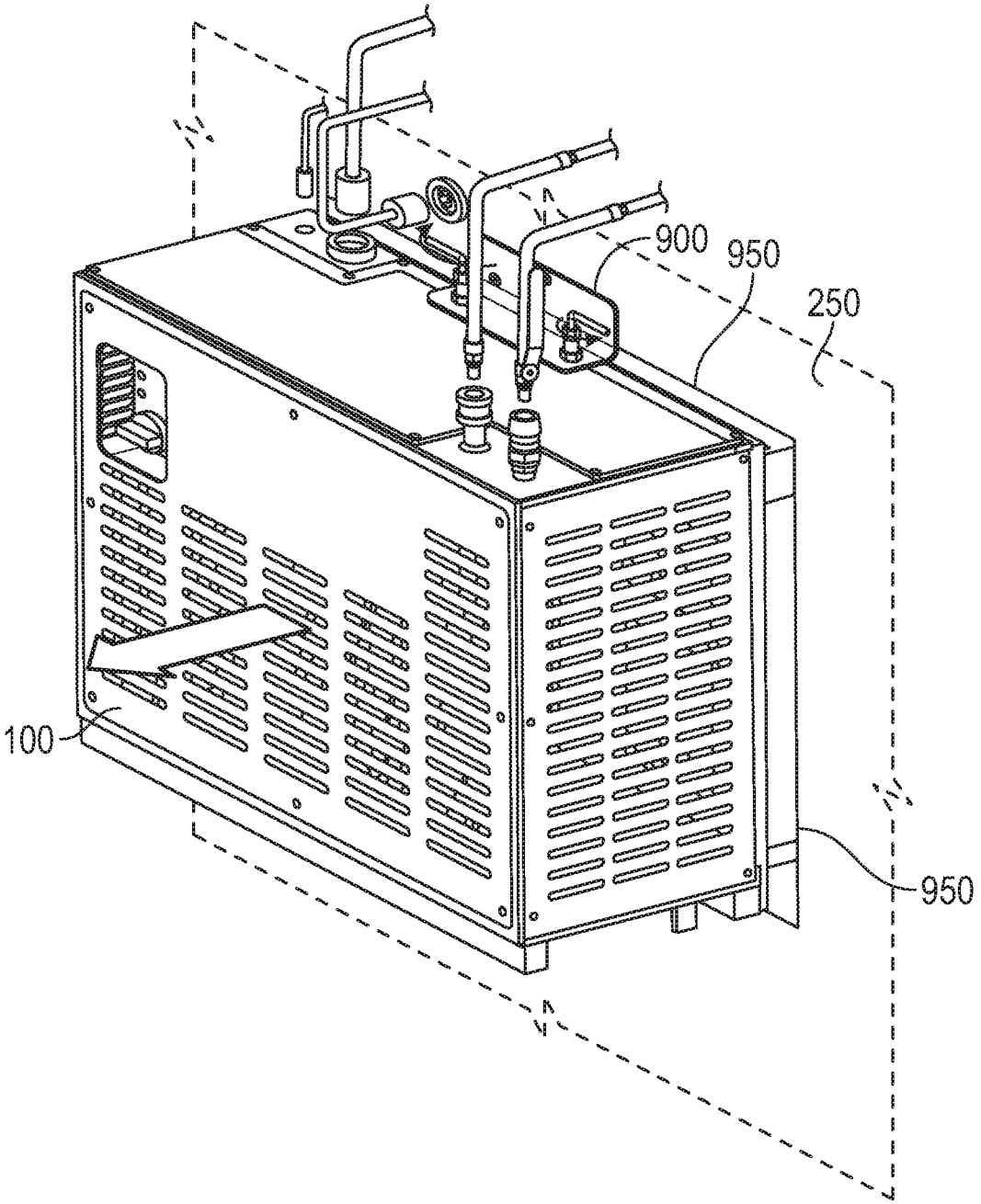
FIG. 10 depicts removal of a modular refrigeration unit from a modular refrigeration system.

FIG. 10 depicts modular refrigeration unit 100 being removed from modular refrigeration system 200. All electrical and water connections between modular refrigeration unit 100 and modular refrigeration system 200 must be disconnected when modular refrigeration unit is removed.

In summary, in line with the foregoing description, modular refrigeration unit 100 may be removed from modular refrigeration system 200 by performing the following steps: 1) disconnect chilled water line 220 from chilled water inlet 130, disconnect chilled water return 230 from chilled water outlet 135, disconnect communications cable 121, disconnect any power connections to output power socket 122 (e.g., a mullion heater 350), and disconnect external power to input power socket 120; 2) then, disengage all quick release pins 930 from each quick release socket 920; 3) then, manually withdraw modular refrigeration unit 100 from wall 250. We speculate that all these disconnection steps can be performed without tools. A modular refrigeration unit 100 may be installed into modular refrigeration system 200 by performing the following steps: 1) manually inserting modular refrigeration unit 100 into wall 250; 2) then, engaging all quick release pins into each quick release socket 920; 3) then connecting chilled water line 220 to chilled water inlet 130, connecting chilled water return to chilled water outlet 135, connect communications cable 121, connect any power connections to output power socket 122 (e.g., a mullion heater 350), and connect external power to input power socket 120. We speculate that all these connection steps can be performed without tools.

Figure 11:
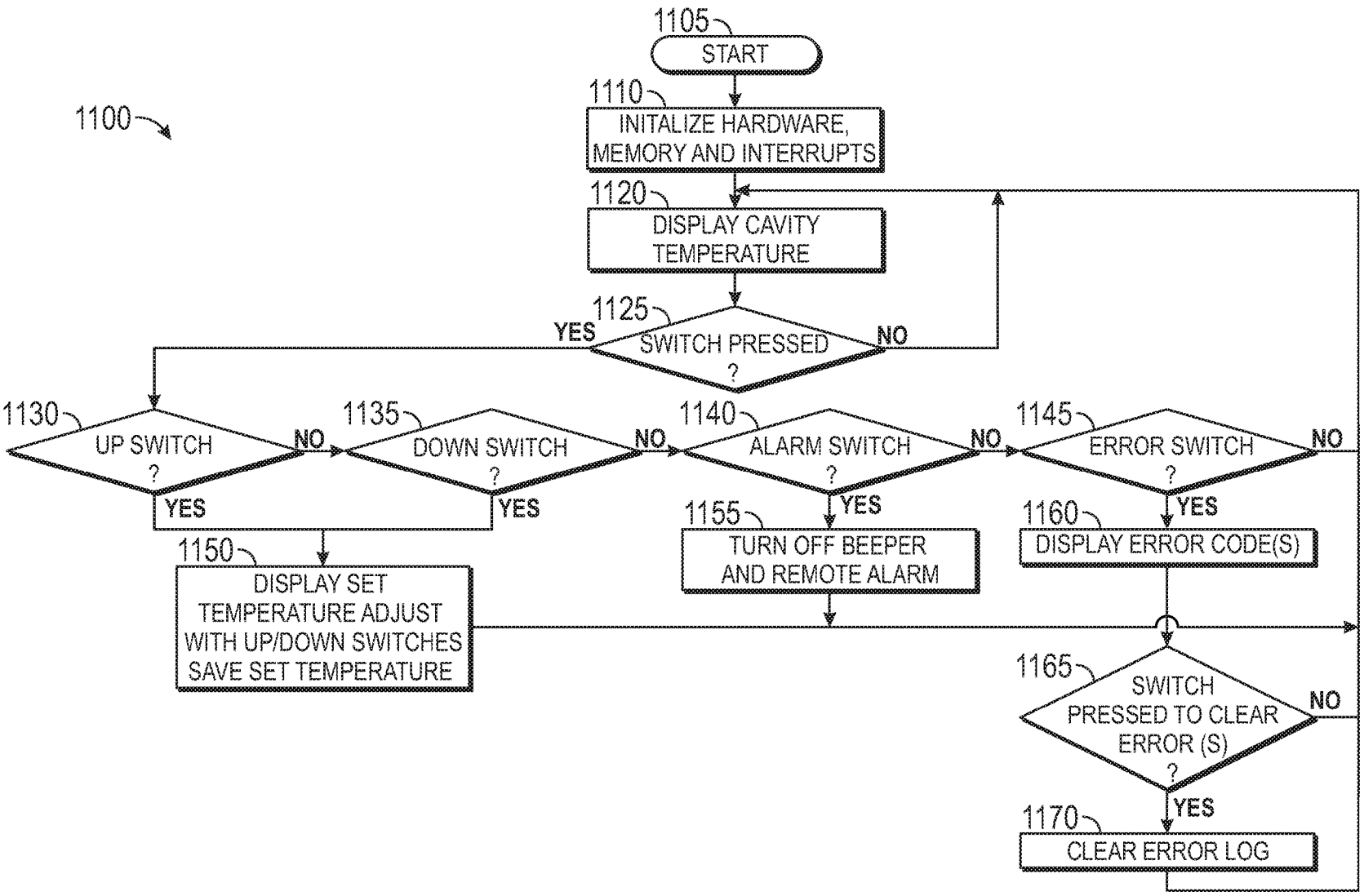
FIG. 11 is a block diagram depicting a method of providing user interaction of a control panel.

FIG. 11 depicts an embodiment of user interaction method 1100, wherein a control panel 305 receives user input and takes actions accordingly. The following paragraphs discuss how user interaction method 1100 works in the context of a cooler control panel 320 having a cooler panel PCB 510 controlling the discussed method. User interaction method 1100 equally applies to a freezer control panel 310 having a freezer panel PCB 610.

User interaction method 1100 operates in a loop until cooler control panel 320 is powered down. Outside of this loop, and after initializing step 1110 is performed, cooler panel PCB 510, performs one or more subroutines other than those discussed in regards to user interaction method 1100, including, without limitation, executing various interrupts and subroutines which are set forth in more detail in U.S. Pat. App. Nos. 62/847,465 (Whitfield et al.) filed May 14, 2019; and 62/862,386 (Whitfield et al.) filed Jun. 17, 2019, which are incorporated herein by reference.

In starting step 1105, cooler panel 320 powers on and starts operations. Then, user interaction method 1100 proceeds to initializing step 1110.

In initializing step 1110, cooler panel PCB 510 performs startup operations, resets memory of cooler panel PCB 510, and begins execution of software instructions. User interaction method 1100 then proceeds to cavity temperature displaying step 1120.

In cavity temperature displaying step 1120, cooler panel PCB510 causes cooler alphanumeric display 321 to display the current temperature of cooler thermometer 520 obtained from cooler cavity temperature cable 327. User interaction method 1100 then proceeds to switch checking step 1125.

In switch checking step 1125, cooler panel PCB 510 checks to see if cooler temperature decrease button 322, cooler temperature increase button 323, cooler alarm reset button 325A, or cooler fault display button 325F have been depressed. If any of these buttons has been pressed by a user, then user interaction method 1100 proceeds to up-switch pressed step 1130. Otherwise, user interaction method 1100 proceeds to cavity temperature displaying step 1120.

In up-switch pressed step 1130, cooler panel PCB 510 checks to see if cooler temperature increase button 323 has been pressed. If so, user interaction method 1100 proceeds to temperature adjusting step 1150, otherwise, user interaction method 1100 proceeds to down-switch pressed step 1135.

In down-switch pressed step 1135, cooler panel PCB510 checks to see if cooler temperature decrease button 322 has been pressed. If so, user interaction method proceeds to temperature adjusting step 1150, otherwise, user interaction method 1100 proceeds to alarm-switch pressed step 1140.

In alarm-switch pressed step 1140, cooler panel PCB510 checks to see if cooler alarm reset button 325A has been pressed. If so, user interaction method 1100 proceeds to alarm silencing step 1155, otherwise, user interaction method 1100 proceeds to error-switch pressed step 1145.

In error-switch pressed step 1145, cooler panel PCB 510 checks to see if cooler fault display button 325F has been pressed. If so, user interaction method 1100 proceeds to error displaying step 1160, otherwise, user interaction method proceeds to cavity temperature displaying step 1120.

In temperature adjusting step 1150, cooler panel PCB 510 checks to see if cooler temperature increase button 323 has been pressed. If so, cooler panel PCB obtains the currently set temperature from memory of cooler panel PCB 510, increases this value by one degree Fahrenheit, and saves the currently set temperature in memory of cooler panel PCB 510. Otherwise, cooler panel PCB 510 checks to see if cooler temperature decrease button 322 has been pressed. If so, cooler panel PCB 510 obtains the currently set temperature from memory of cooler panel PCB 510, decreases this value by one degree Fahrenheit, and saves the currently set temperature in memory of cooler panel PCB 510. Then, cooler panel PCB 510 displays the currently set temperature on cooler alphanumeric display 321. Then, user interaction method 1100 proceeds to cavity temperature displaying step 1120. In other embodiments, degrees Celsius may be used, and one button press may increment or decrement the currently set temperature by more than, or less than, one degree. User interaction method 1100 then proceeds to cavity temperature displaying step 1120.

In alarm silencing step 1155, cooler panel PCB510 checks to see if cooler alarm reset button 325A is pressed. If so, cooler panel PCB 510 silences any alarms that are currently alarming (e.g., cooler door open beeping is silenced, any other local alarms are silenced, and any remote alarms are silenced). User interaction method 1100 then proceeds to cavity temperature displaying step 1120.

In error displaying step 1160, cooler panel PCB 510 checks to see if cooler fault display button 325F is pressed. If so, cooler panel PCB 510 displays a current error code on cooler alphanumeric display 321. User interaction method 1100 then proceeds to error-clear-checking step 1165.

In error-clear-checking step 1165, cooler panel PCB 510 checks to see if a cooler error clear switch is pressed. If so, user interaction method 1100 proceeds to error clearing step 1170. Otherwise, user interaction method 1100 proceeds to cavity temperature displaying step 1120.

In error clearing step 1170, cooler panel PCB 510 clears all current error logs. User interaction method then proceeds to cavity temperature displaying step 1120.

Figure 12:
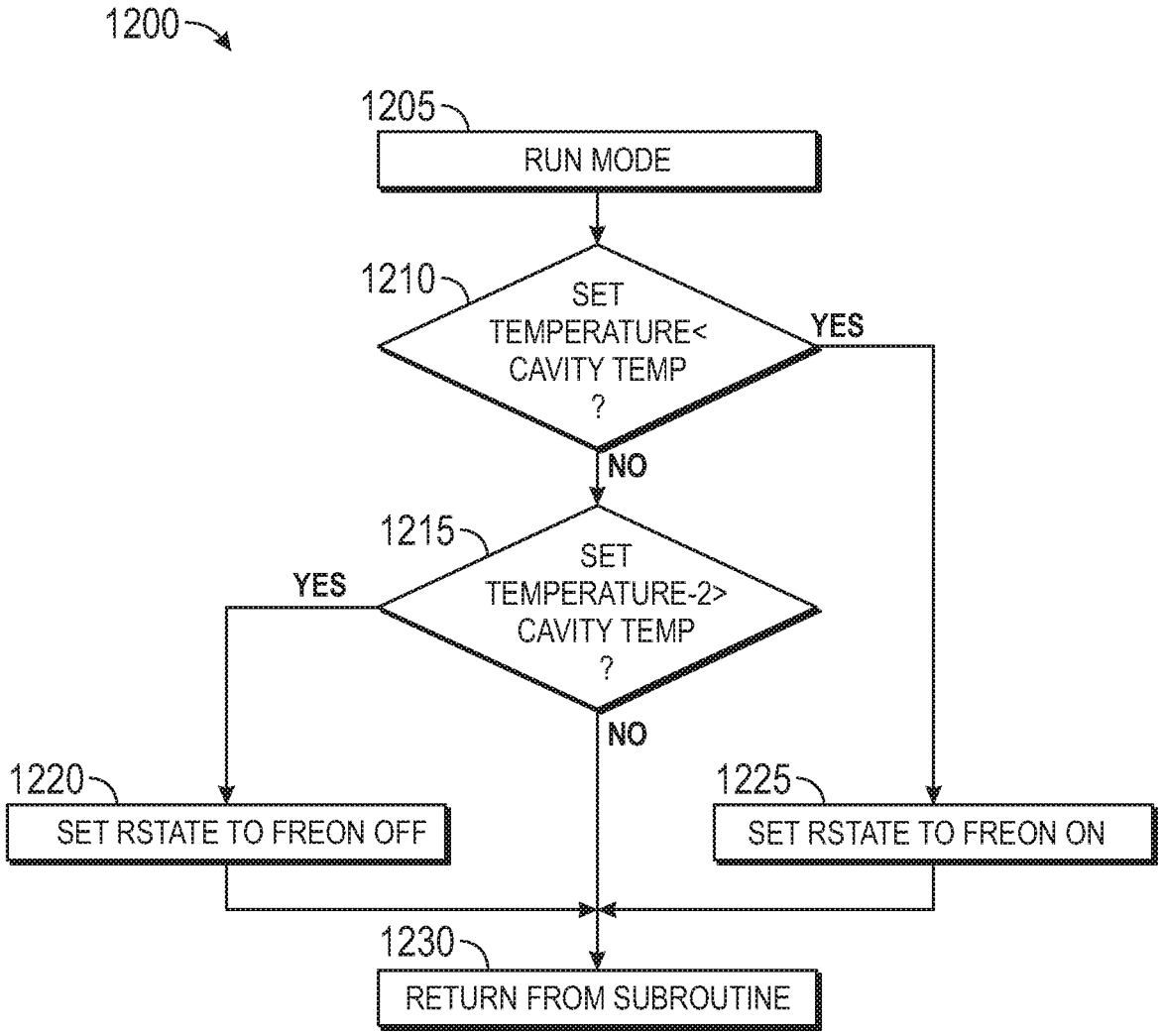
FIG. 12 is a block diagram depicting a method of controlling temperature within a cavity of a modular refrigeration system.

FIG. 12 depicts an embodiment of temperature adjusting method 1200, whereby a control panel 305 reacts to adjust the temperature of an interior space 280. The following paragraphs discuss how temperature adjusting method 1200 works in the context of a cooler control panel 320 having a cooler panel PCB 510 controlling the discussed method. Temperature adjusting method 1200 equally applies to a freezer control panel 310 having a freezer panel PCB 610.

In temperature subroutine beginning step 1205, cooler panel PCB 510 enters a subroutine for adjusting temperature. In an embodiment, this subroutine is an interrupt task that is scheduled to occur at regular intervals. Temperature adjusting method 1200 then proceeds to cavity high checking step 1210.

In cavity high checking step 1210, cooler panel PCB 510 compares the current cavity temperature obtained from cooler thermometer 520 via cooler cavity temperature cable 327 to the currently set temperature set in user interaction method 1100. If the set temperature is less than the cavity temperature, then temperature adjusting method 1200 proceeds to refrigerant-on step 1225. Otherwise, temperature adjusting method 1200 proceeds to cavity low checking step 1215.

In cavity low checking step 1215, cooler panel PCB 510 compares the current cavity temperature obtained from cooler thermometer 520 via cooler cavity temperature cable 327 to the currently set temperature set in user interaction method 1100. If the set the cavity temperature is more than two degrees lower than the set temperature, then temperature adjusting method 1200 proceeds to refrigerant-off step 1220. Otherwise, temperature adjusting method 1200 proceeds to temperature subroutine ending step 1230. In other embodiments, the difference in temperatures may be more than, or less, than two degrees. We speculate that a two degree difference allows the refrigerated interior space 282 to become cool enough that modular refrigeration units 100 are turned on for a long enough period to achieve efficiency, but without the refrigerated interior space 282 being cooled to a temperature that varies too significantly from the set temperature. In embodiments using a two degree difference, the minimum user-set temperature for a cooler panel 320 is 34 degrees Fahrenheit, ensuring that the refrigerated interior space 282 does not freeze.

In refrigerant-off step 1220, cooler panel PCB 510 sets a refrigerant state variable to OFF for all modular refrigeration units 100 of the modular refrigeration system 200 controlled by cooler panel PCB 510. Temperature adjusting method 1200 then proceeds to temperature subroutine ending step 1230. The refrigerant state variable is sent to one or more modular refrigeration units 100 of modular refrigeration system 200 in state transfer method 1400, discussed in more detail below. When the modular refrigeration units 100 receive a transferred state having the refrigerant state variable set to OFF, the modular refrigeration units cease cooling operation, thereby stopping cooling refrigerated interior space 282.

In refrigerant-on step 1225 cooler panel PCB 510 sets a refrigerant state variable to ON for all modular refrigeration units 100 of the modular refrigeration system 200 controlled by cooler panel PCB 510. Temperature adjusting method 1200 then proceeds to temperature subroutine ending step 1230. The refrigerant state variable is sent to one or more modular refrigeration units 100 of modular refrigeration system 200 in state transfer method 1400, discussed in more detail below. When the modular refrigeration units 100 receive a transferred state having the refrigerant state variable set to ON, the modular refrigeration units 100 engage cooling operation, thereby cooling refrigerated interior space 282.

In temperature subroutine ending step 1230, the subroutine for adjusting temperature ends, and temperature adjusting method 1200 ends.

Figure 13:
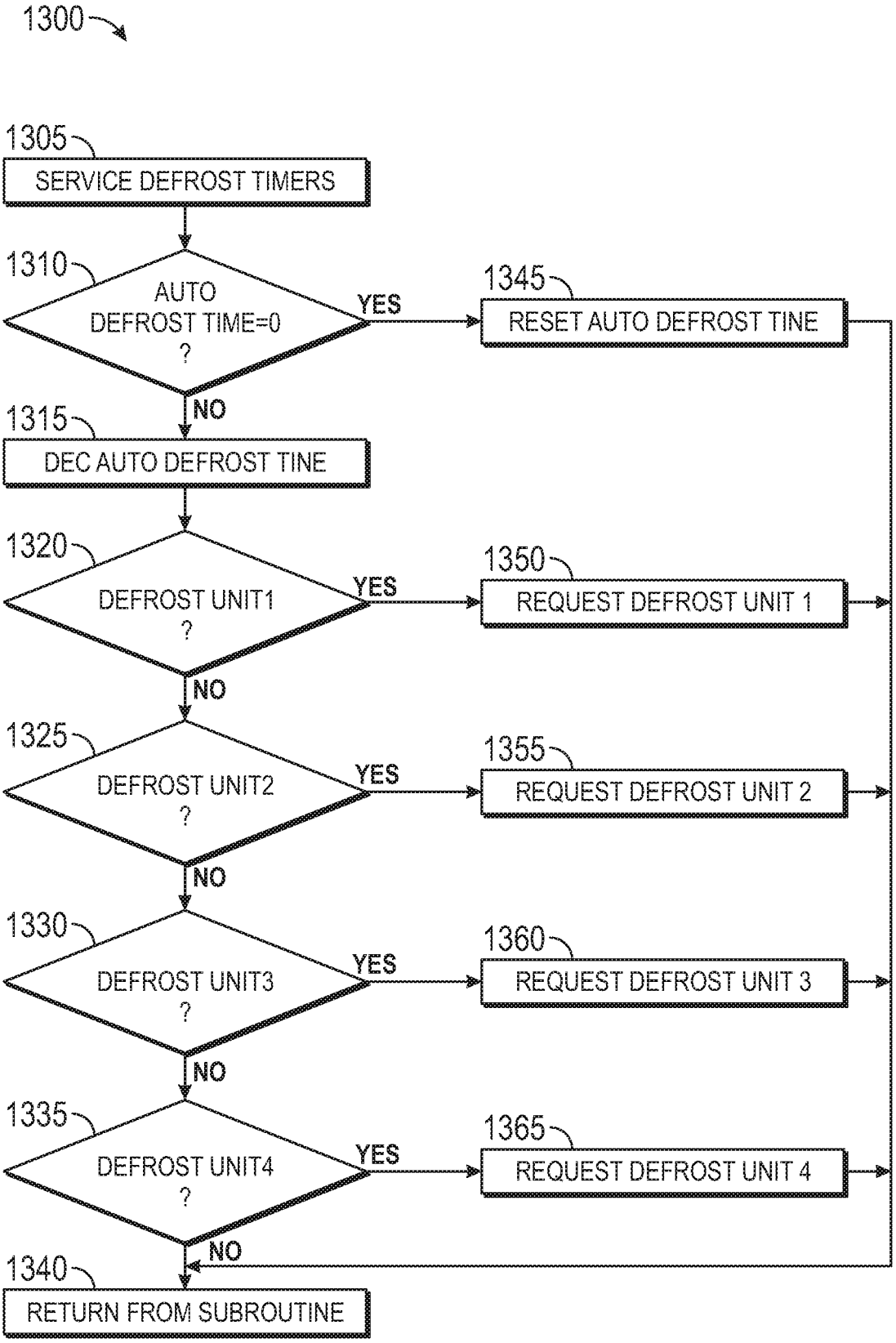
FIG. 13 is a block diagram depicting a method of staggering defrost cycles in a modular refrigeration system.

FIG. 13 depicts an embodiment of defrost scheduling method 1300, whereby a control panel 305 sends defrost commands to four modular refrigeration units 100 in a staggered fashion, such that only a limited number of the four modular refrigeration units 100 are in defrost mode (i.e., cooling operation is not engaged) at the same time. However, in other embodiments, different numbers of modular refrigeration units 100 may be used. In certain embodiments, a control panel 305 performs defrost scheduling method 1300 by executing an interrupt subroutine at regular intervals. The following paragraphs discuss how defrost scheduling method 1300 works in the context of a cooler control panel 320 having a cooler panel PCB 510 controlling the discussed method. Defrost scheduling method 1300 equally applies to a freezer control panel 310 having a freezer panel PCB 610. In scheduling beginning step 1305, cooler panel PCB 510 begins executing a subroutine and then proceeds to counter checking step 1310.

In counter checking step 1310, cooler panel PCB 510 checks a system defrost timer variable 1810. If the system defrost timer variable 1810 is zero, defrost scheduling method 1300 proceeds to resetting step 1345. Otherwise, defrost scheduling method 1300 proceeds to counter decrementing step 1315.

In one embodiment, defrost scheduling method 1300 is performed once per second, and the system defrost timer variable 1810 represents a number of seconds.

In counter decrementing step 1315, cooler panel PCB 510 decreases the system defrost timer variable 1810 by one, then defrost scheduling method 1300 proceeds to first unit checking step 1320.

In first unit checking step 1320, cooler panel PCB 510 checks to see if the system defrost timer variable 1810 is equal to the defrost time setting for a first modular refrigeration unit 100. If so, defrost scheduling method 1300 proceeds to first unit defrost requesting step 1350. Otherwise, defrost scheduling method 1300 proceeds to second unit checking step 1325. The defrost time settings for various embodiments are set forth below.

In second unit checking step 1325, cooler panel PCB 510 checks to see if the system defrost timer variable 1810 is equal to the defrost time setting for a second modular refrigeration unit 100. If so, defrost scheduling method 1300 proceeds to second unit defrost requesting step 1355. Otherwise, defrost scheduling method 1300 proceeds to third unit checking step 1330. The defrost time settings for various embodiments are set forth below.

In third unit checking step 1330, cooler panel PCB 510 checks to see if the system defrost timer variable 1810 is equal to the defrost time setting for a third modular refrigeration unit 100. If so, defrost scheduling method 1300 proceeds to third unit defrost requesting step 1360. Otherwise, defrost scheduling method 1300 proceeds to fourth unit checking step 1335. The defrost time settings for various embodiments are set forth below.

In fourth unit checking step 1335, cooler panel PCB 510 checks to see if the system defrost timer variable 1810 is equal to the defrost time setting for a fourth modular refrigeration unit 100. If so, defrost scheduling method 1300 proceeds to fourth unit defrost requesting step 1365. Otherwise, defrost scheduling method 1300 proceeds to scheduling ending step 1340. The defrost time settings for various embodiments are set forth below.

In resetting step 1345, cooler panel PCB 510 resets the system defrost timer variable 1810 to the appropriate setting, then defrost scheduling method 1300 proceeds to scheduling ending step 1340.

In certain embodiments, the system defrost timer variable 1810 is reset to a time period representing two hours or four hours when defrost scheduling method 1300 is performed for a cooler, and to a time period representing four hours or six hours when defrost scheduling method 1300 is performed for a freezer. The defrost time settings for various embodiments are listed below in hours. Actual values are multiplied to match the frequency at which defrost scheduling method 1300 is performed. In one embodiment where defrost scheduling method 1300 is performed two times each second, values are multiplied by 7200 (i.e., 60 minutes*60 seconds*2). Other embodiments may use different settings.

| | 2 Hour Defrost Cycle (cooler) | 4 Hour Defrost Cycle cooler or freezer) | 6 Hour Defrost Cycle(freezer) |
|---|---|---|---|
| Unit 1 | 0.25 Hours | 0.5 Hours | 0.5 Hours |
| Unit 2 | 0.75 Hours | 1.5 Hours | 2 Hours |
| Unit 3 | 1.25 Hours | 2.5 Hours | 3.5 Hours |
| Unit 4 | 1.75 Hours | 3.5 Hours | 5 Hours |

In first unit defrost requesting step 1350, cooler panel PCB 510 sets a defrost state variable to ON for a first modular refrigeration unit 100. Defrost scheduling method 1300 then proceeds to scheduling ending step 1340.

In second unit defrost requesting step 1355, cooler panel PCB 510 sets a defrost state variable to ON for a second modular refrigeration unit 100. Defrost scheduling method 1300 then proceeds to scheduling ending step 1340.

In third unit defrost requesting step 1360, cooler panel PCB 510 sets a defrost state variable to ON for a third modular refrigeration unit 100. Defrost scheduling method 1300 then proceeds to scheduling ending step 1340.

In fourth unit defrost requesting step 1365, cooler panel PCB 510 sets a defrost state variable to ON for a fourth modular refrigeration unit 100. Defrost scheduling method 1300 then proceeds to scheduling ending step 1340.

The defrost state variable is sent to the all modular refrigeration units 100 connected to cooler panel PCB 510 in state transfer method 1400, discussed in more detail below. When a modular refrigeration unit 100 receives a transferred state having the defrost state variable set to ON, the modular refrigeration unit 100 engages defrost operation.

In scheduling ending step 1340 the subroutine for scheduling defrost ends, and defrost scheduling method 1300 ends.

Figure 14A:
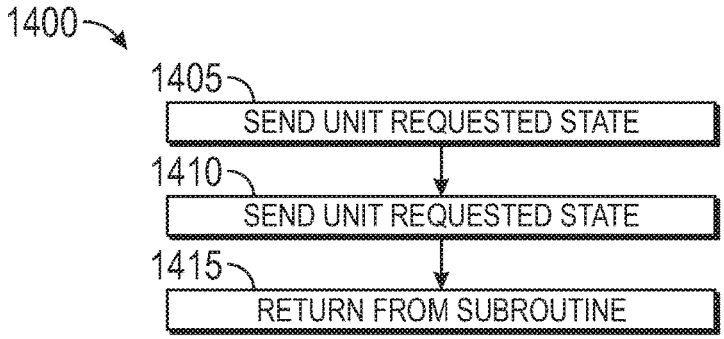
FIG. 14A is a block diagram depicting a method of sending commands from a control panel to a modular refrigeration unit of a modular refrigeration system.

FIG. 14A depicts an embodiment of state transfer method 1400. In state transfer method 1400, cooler panel PCB 510 and freezer panel PCB 610 communicate with the modular refrigeration units 100 to which each is connected via communications cables 210.

In transfer starting step 1405, the cooler panel PCB 510 or freezer panel PCB 610 performing transfer starting step 1405 assembles variables collectively representing the desired state of modular refrigeration unit 100 into an assembled state variable 1820. Then, state transfer method 1400 proceeds to data transfer step 1410. In one embodiment, various commands are bitwise combined into an 8-bit state variable, having the following settings:

| Bit | ON | OFF |
|---|---|---|
| Bit 7 | Clear Errors | No Action |
| Bit 6, Bit 5, Bit 4 | No Action | No Action |
| Bit 3 | Operate as Freezer | Operate as Refrigerator |
| Bit 2 | Fans ON | Fans OFF |
| Bit 1 | Regular Operation | Defrost Mode ON |
| Bit 0 | Cooling Mode On | Cooling Mode Off |

In data transfer step 1410, the cooler panel PCB 510 or freezer panel PCB 610 performing data transfer step 1410 outputs the assembled state variable 1820 to the communications cable 210 connected to a particular modular refrigeration unit 100 intended to receive the assembled state variable 1820. Then, state transfer method 1400 proceeds to transfer completion step 1415.

In transfer completion step 1415, the subroutine for transferring state ends, and state transfer method 1400 ends.

Figure 14B:
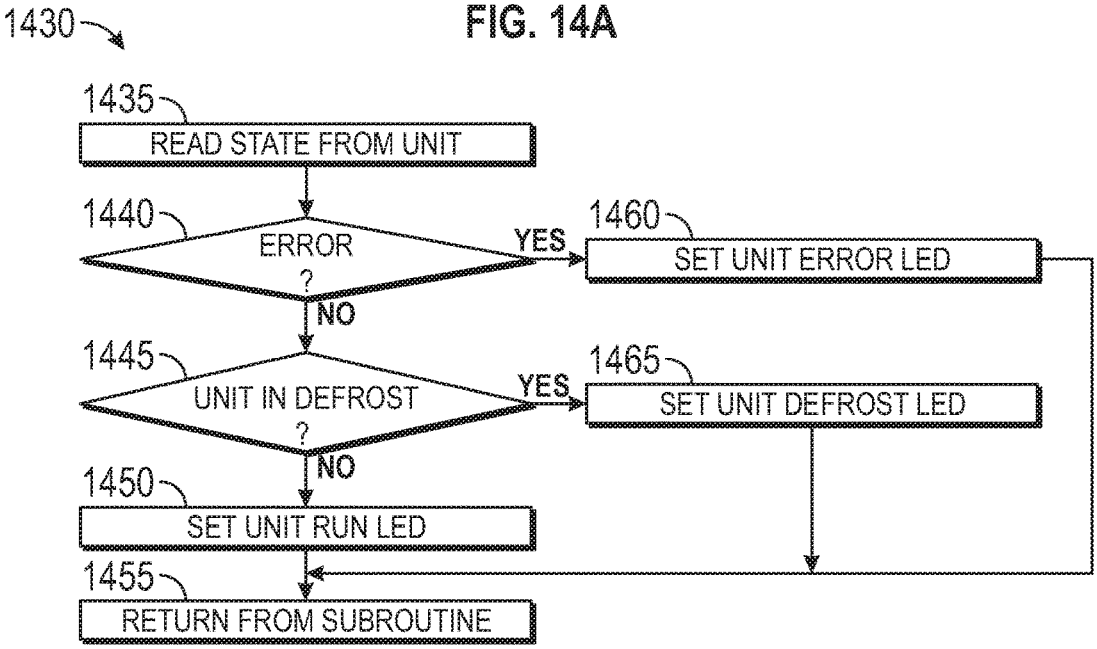
FIG. 14B is a block diagram depicting a method of a control panel obtaining information from a modular refrigeration unit.

FIG. 14B depicts an embodiment of state reading method 1430, whereby a control panel 305 receives state information, including, without limitation, error information, from a modular refrigeration unit 100 connected by a communications cable 210. The following paragraphs discuss how state reading method 1430 works in the context of a cooler control panel 320 having a cooler panel PCB 510 controlling the discussed method. State reading method 1430 equally applies to a freezer control panel 310 having a freezer panel PCB 610. The following paragraphs also discuss state reading method 1430 in the context of a single modular refrigeration unit 100. However, state reading method 1430 equally applies to a system having a plurality of modular refrigeration units 100 connected to a control panel 305 by a plurality of communications cables 210.

In state reading starting step 1435, cooler panel PCB 510 begins executing a subroutine, reads a unit state variable 1830 from a modular refrigeration unit 100 connected via a communications cable 210 and then proceeds to error checking step 1440.

In error checking step 1440, cooler panel PCB 510 determines whether the modular refrigeration unit 100 is currently in an error state by reading the unit state variable 1830 obtained in state reading starting step 1435. If modular refrigeration unit 100 is currently in an error state, state reading method 1430 proceeds to error light setting step 1460. Otherwise, state reading method 1430 proceeds to defrost checking step 1445.

In defrost checking step 1445, cooler panel PCB 510 determines whether the modular refrigeration unit 100 is currently in a defrost mode by reading the state variable obtained in state reading starting step 1435. If modular refrigeration unit 100 is currently in a defrost state, state reading method 1430 proceeds to defrost light setting step 1465. Otherwise, state reading method 1430 proceeds to run light setting step 1450.

In run light setting step 1450, cooler panel PCB 510 engages a cooler operating indicator 324 indicating that modular refrigeration unit 100 is operating. State reading method 1430 then proceeds to state reading ending step 1455.

In state reading ending step 1455, the subroutine for reading state ends, and state reading method 1430 ends.

In error light setting step 1460, cooler panel PCB 510 engages a cooler operating indicator 324 indicating that modular refrigeration unit 100 is in an error state. State reading method 1430 then proceeds to state reading ending step 1455.

In defrost light setting step 1465, cooler panel PCB 510 engages a cooler operating indicator 324 indicating that modular refrigeration unit 100 is in a defrost state. State reading method 1430 then proceeds to state reading ending step 1455.

Figure 14C:
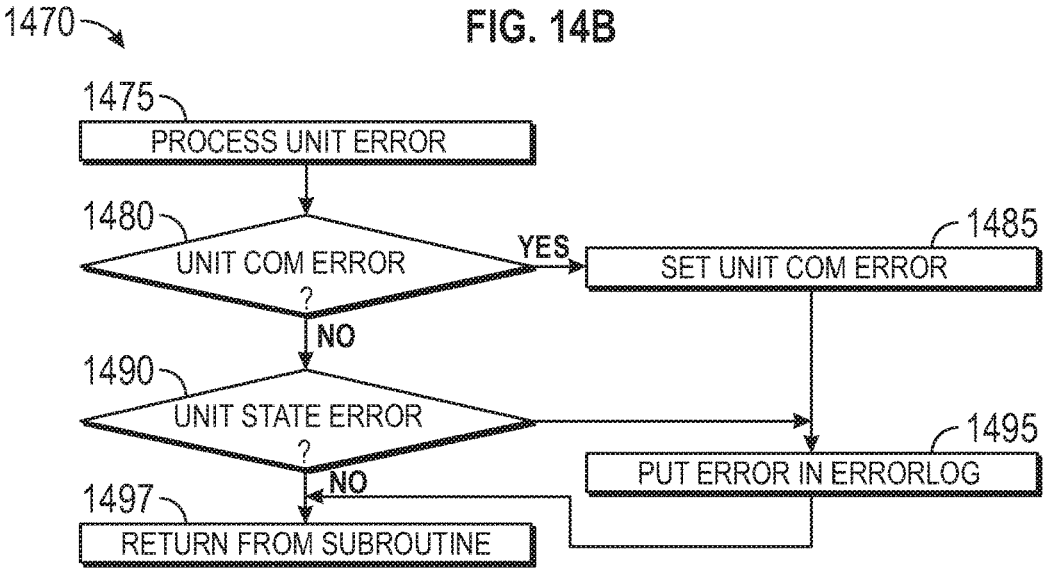
FIG. 14C is a block diagram depicting a method of a control panel processing errors occurring in a modular refrigeration unit.

FIG. 14C depicts an embodiment of error processing method 1470, whereby a control panel 305 processes error information received from a modular refrigeration unit 100 connected by a communications cable 210. The following paragraphs discuss how error processing method 1470 works in the context of a cooler control panel 320 having a cooler panel PCB510 controlling the discussed method. Error processing method 1470 equally applies to a freezer control panel 310 having a freezer panel PCB 610. The following paragraphs also discuss error processing method 1470 in the context of a single modular refrigeration unit 100. However, error processing method 1470 equally applies to a system having a plurality of modular refrigeration units 100 connected to a control panel 305 by a plurality of communications cables 210.

In error processing starting step 1475, cooler panel PCB 510 begins executing a subroutine and then proceeds to communications checking step 1480.

In communications checking step 1480, cooler panel PCB 510 determines if cooler panel PCB 510 is currently able to communicate with modular refrigeration unit 100. Cooler panel PCB 510 may not be able to communicate with modular refrigeration unit 100 if, as nonlimiting examples, communications cable 210 is not connected to modular refrigeration unit 100, communications cable 210 becomes severed, or if modular refrigeration unit 100 becomes inoperable. If cooler panel PCB 510 is not able to communicate with modular refrigeration unit 100, error processing method 1470 proceeds to error setting step 1485. Otherwise, error processing method 1470 proceeds to error checking step 1490.

In error setting step 1485, cooler panel PCB 510 records in system memory that modular refrigeration unit 100 is in a communications failure state. Then, error processing method 1470 proceeds to error logging step 1495.

In error checking step 1490, cooler panel PCB 510 determines whether the modular refrigeration unit 100 is currently in an error state by reading the unit state variable 1830 obtained in state reading starting step 1435. If modular refrigeration unit 100 is currently in an error state, error processing method 1470 proceeds to error logging step 1495. Otherwise, error processing method 1470 proceeds to error processing ending step 1497.

In error logging step 1495, cooler panel PCB 510 records the current error state variable and the communications status in system memory. Then, error processing method 1470 proceeds to error processing ending step 1497.

In error processing ending step 1497, the subroutine for processing errors ends, and error processing method 1470 ends.

Figure 15:
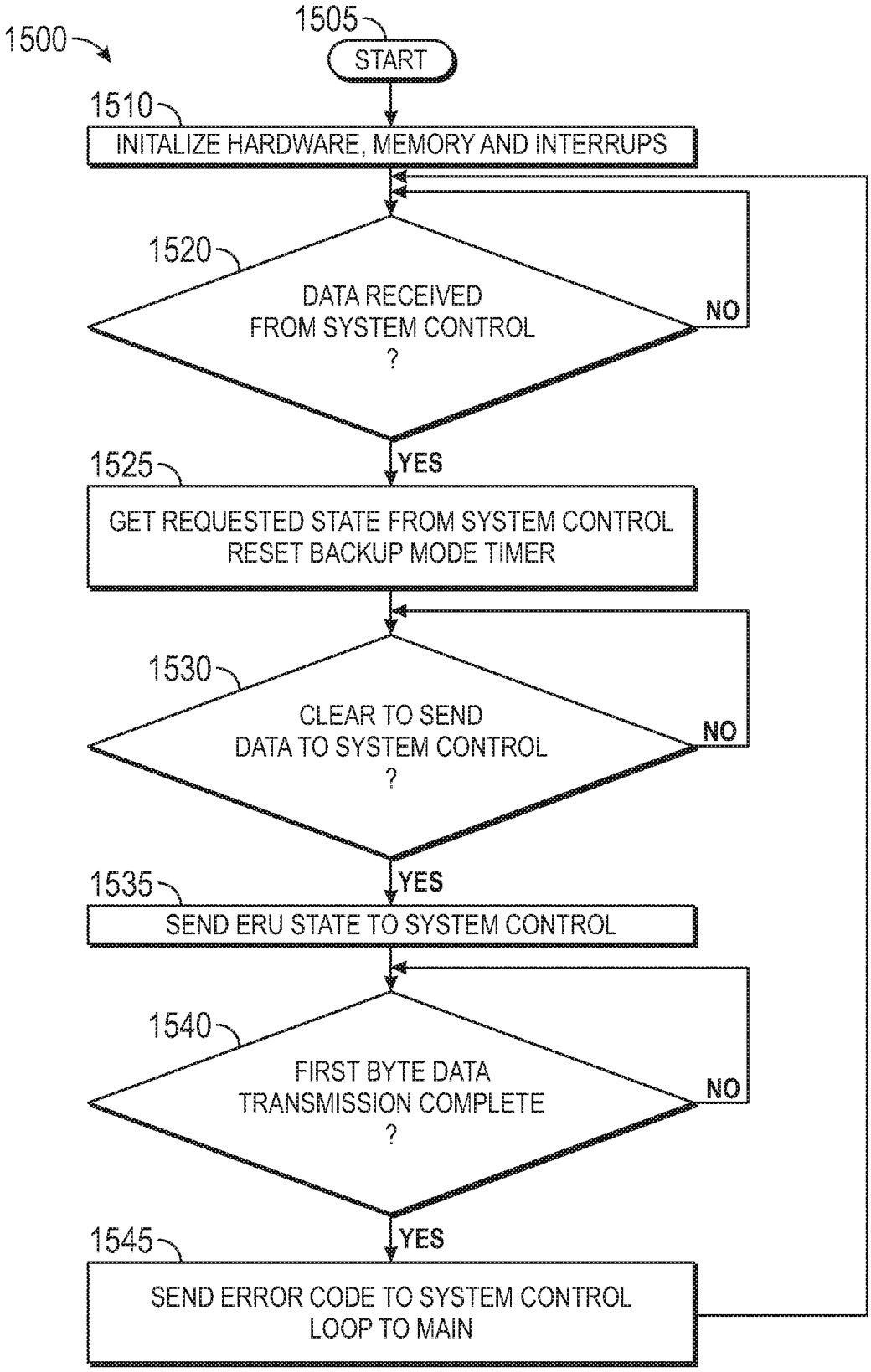
FIG. 15 is a block diagram depicting a method of a modular refrigeration unit communicating with a control panel.

FIG. 15 depicts an embodiment of module communications method 1500, wherein a modular refrigeration unit 100 receives commands from a control panel 305 and reports unit state to a modular refrigeration unit 100.

Module communications method 1500 operates in a loop until modular refrigeration unit 100 is powered down. Outside of this loop, and after unit initializing step 1510 is performed, modular refrigeration unit 100, performs one or more subroutines other than those discussed in regards to module communications method 1100, including, without limitation, executing various interrupts and subroutines which are set forth in more detail in U.S. Pat. App. Nos. 62/847,465 (Whitfield et al.) filed May 14, 2019; and 62/862,386 (Whitfield et al.) filed Jun. 17, 2019, which are incorporated herein by reference.

In unit starting step 1505, modular refrigeration unit 100 powers on and starts operations. Then, module communications method 1100 proceeds to unit initializing step 1510.

In unit initializing step 1510, unit PCB 410 performs startup operations, resets memory of unit PCB 410, and begins execution of software instructions. Module communications method 1500 then proceeds to data receiving step 1520.

In data receiving step 1520, unit PCB 410 determines if data has been received from a control panel 305 via communications cable 210. If so, module communications method then proceeds to command processing step 1525. Otherwise, module communications method 1500 repeats data receiving step 1520.

In command processing step 1525, unit PCB 410 reads the assembled state variable 1820 sent by control panel 305 in data transfer step 1410 of state transfer method 1400. Unit PCB 410 also stores the assembled state variable 1820 as a command state variable 1840 in memory of unit PCB 410. In some embodiments, a command state variable 1840 is also referred to as a requested state variable. Unit PCB 410 also resets a backup mode timer variable 1880. In one embodiment, the backup mode timer variable 1880 is reset to a value representing 30 seconds. Then, module communications method 1500 proceeds to communications synchronizing step 1530.

In communications synchronizing step 1530 determines if communications cable 210 is currently being utilized. If so, module communications method repeats communications synchronizing step 1530. Otherwise, module communications method 1500 proceeds to state transmission step 1535.

In state transmission step 1535, unit PCB 410 assembles and begins transmission of the unit state variable 1830 stored in unit PCB 410 of modular refrigeration unit 100 to control panel 305 via communications cable 210. This unit state variable 1830 is received by control panel 305 in state reading method 1430. Module communications method 1500 then proceeds to data sending step 1540.

In data sending step 1540, unit PCB 410 determines if transmission of the unit state variable 1830 has been completed. If so, module communications method 1500 proceeds to code transmission step 1545. Otherwise, module communications method 1500 repeats data sending step 1540.

In code transmission step 1545, unit PCB 410 sends error codes associated with any errors indicated in the unit state variable 1830 to control panel 305 via communications cable 210. Module communications method then proceeds to data receiving step 1520.

Figure 16A:
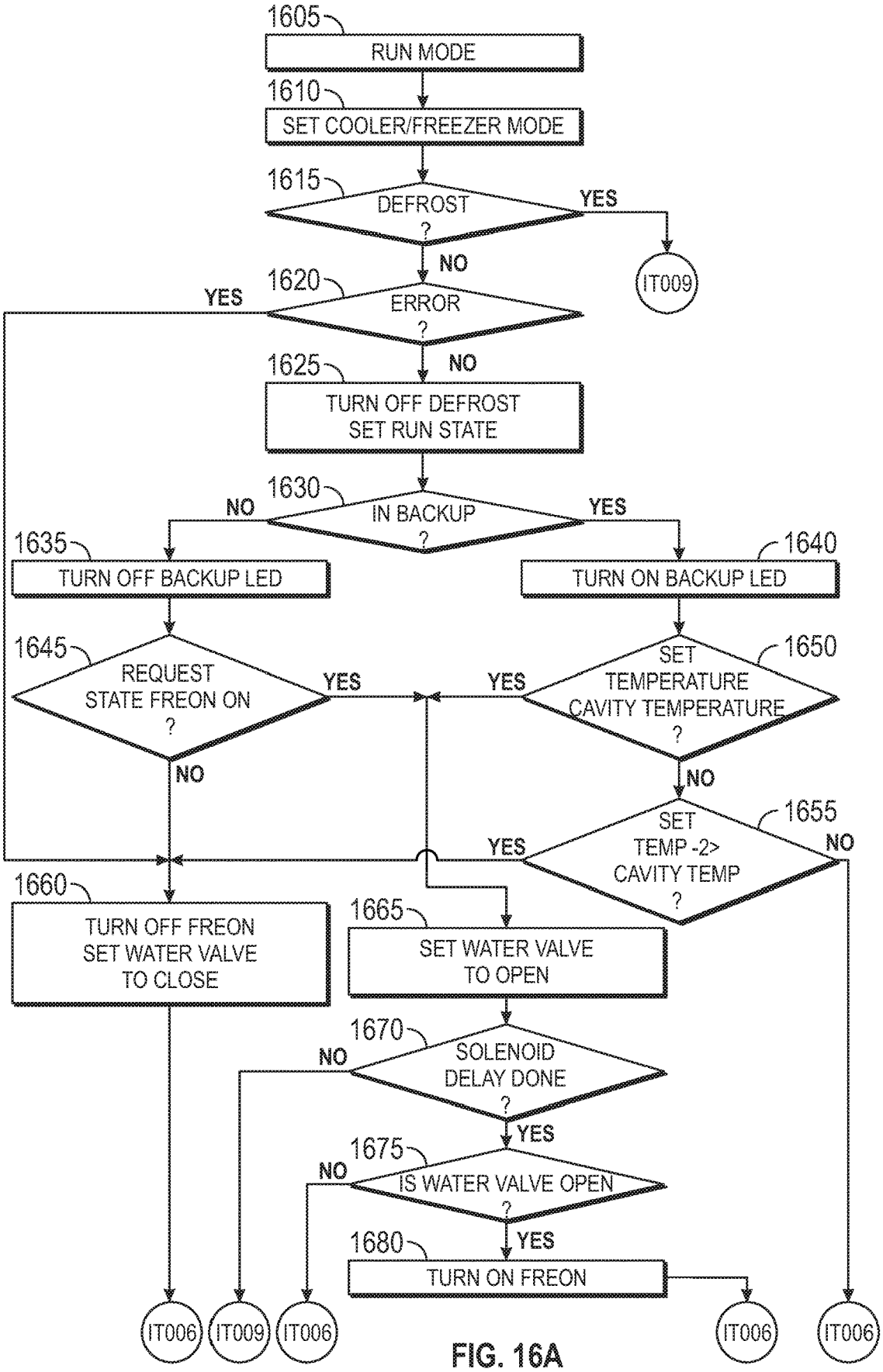
FIGS. 16A and 16B are a single block diagram depicting a method of operation of a modular refrigeration unit.
Figure 16B:
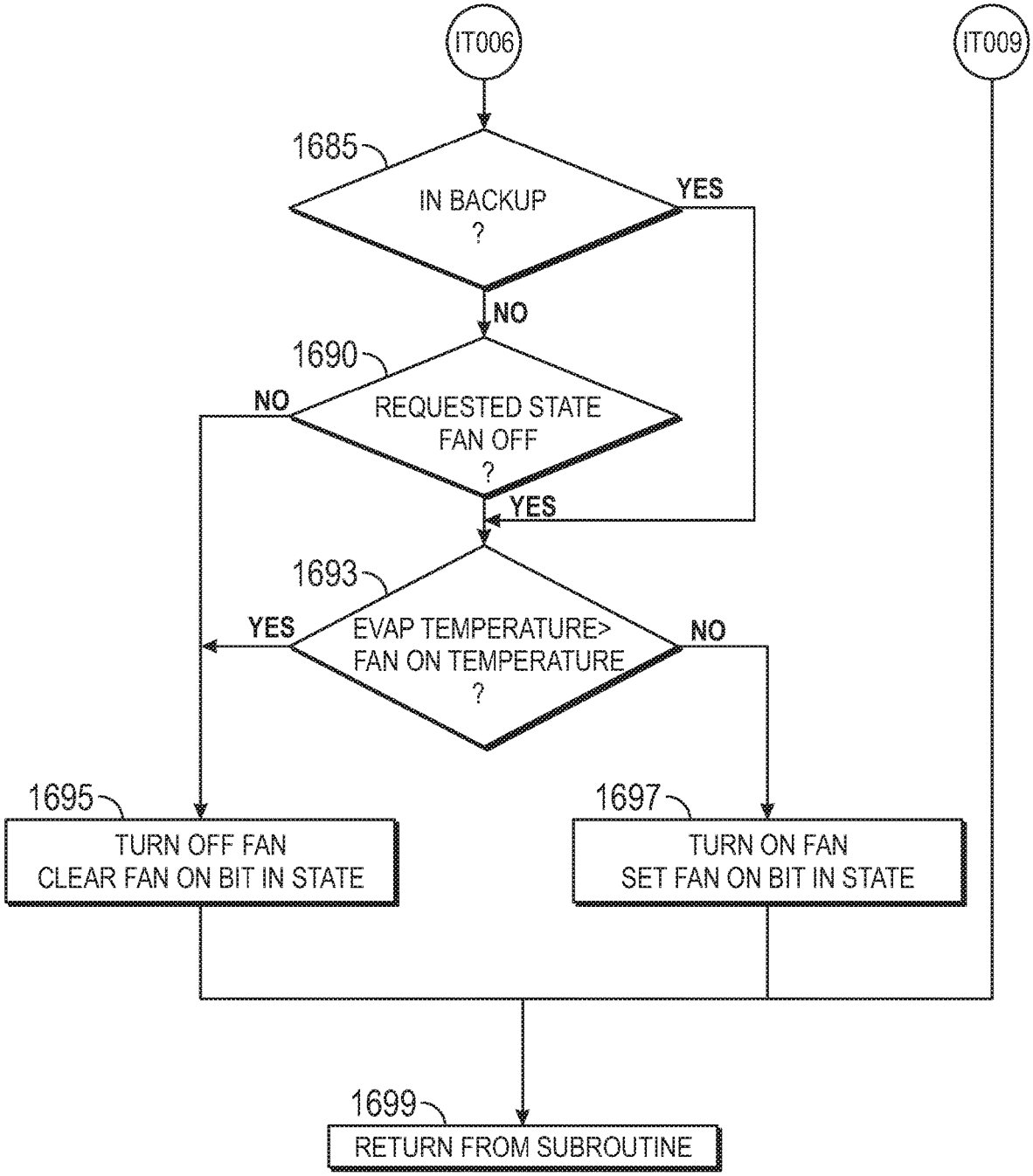

FIGS. 16A and 16B depict an embodiment of cooling operations method 1600, wherein a unit PCB410 controls operations of a modular refrigeration unit 100 in response to commands received from a control panel 305 via module communications method 1500. Cooling operations method 1600 operates as an interrupt subroutine that is executed at regular intervals. In certain embodiments, the interval may be less than one second. In one embodiment, cooling operations method 1600 cannot run until command processing step 1525 of module communications method 1500 has executed at least once after modular refrigeration unit 100 has powered on.

In cooling method starting step 1605, unit PCB 410 begins executing a subroutine implementing the steps of cooling operations method 1600. Then, cooling operations method 1600 proceeds to mode setting step 1610.

In mode setting step 1610, unit PCB 410 configures modular refrigeration unit 100 for operation as either a refrigerator or a freezer. In an embodiment, unit PCB 410 makes this configuration after checking, and in response to, the command state variable 1840 stored in memory of unit PCB410 during command processing step 1525 of module communications method 1500. If the command state variable 1840 indicates that modular refrigeration unit 100 should run as a freezer, unit PCB 410 performs cooling operations method 1600 as a freezer, and if the command state variable 1840 indicates that modular refrigeration unit 100 should run as a refrigerator, unit PCB 410 performs cooling operations method 1600 as a refrigerator. In one embodiment, mode setting step 1610 effects this performance of cooling operations method 1600 by setting one or more temperature variables that are accessed by other steps of cooling operations method 1600. Cooling operations method 1600 then proceeds to unit defrost checking step 1615.

In unit defrost checking step 1615, unit PCB 410 checks to see if modular refrigeration unit 100 is currently in a defrost mode. If so, cooling operations method 1600 proceeds to cooling method ending step 1699. Otherwise, cooling operations method 1600 proceeds to unit error checking step 1620. In various embodiments, unit PCB 410 checks a command state variable 1840 or other variables in memory of unit PCB 410 to determine if modular refrigeration unit 100 is currently in a defrost mode.

In unit error checking step 1620, unit PCB 410 checks to see if modular refrigeration unit 100 is currently experiencing an error. If so, cooling operations method 1600 proceeds to cooling disengaging step 1660. Otherwise, cooling operations method 1600 proceeds to run state setting step 1625. In various embodiments, unit PCB 410 checks one or more variables in memory of unit PCB 410 to determine if modular refrigeration unit 100 is currently experiencing an error, where said one or more variables in memory may represent status of various components of modular refrigeration unit 100.

In run state setting step 1625, unit PCB 410 closes hot gas solenoid valve 169 and sets the running mode of modular refrigeration unit 100 to reflect that cooling mode is on, and defrost mode is off. In an embodiment, unit PCB 410 sets an actual state variable 1850 (in contrast to a command state variable 1840) to indicate that, for modular refrigeration unit 100, cooling mode is on and defrost mode is off. Unit PCB 410 also sets a value in memory that results in the closing of hot gas solenoid valve 169. Then, cooling operations method 1600 proceeds to first backup checking step 1630.

In first backup checking step 1630, unit PCB 410 determines if modular refrigeration unit 100 is operating in a backup mode. In an embodiment, unit PCB 410 determines if modular refrigeration unit 100 is operating in a backup mode by determining if a backup mode timer variable 1880 is set to zero. If modular refrigeration unit 100 is operating in backup mode, then cooling operations method 1600 proceeds to backup light engaging step 1640. Otherwise, cooling operations method proceeds to backup light disengaging step 1635.

In backup light disengaging step 1635, unit PCB 410 disengages an operation indicator 106 indicating that modular refrigeration unit 100 is operating in backup mode. Cooling operations method 1600 then proceeds to cooling state checking step 1645.

In backup light engaging step 1640, unit PCB 410 engages an operation indicator 106 indicating that modular refrigeration unit 100 is operating in backup mode. Cooling operations method 1600 then proceeds to unit cavity high checking step 1650.

In cooling state checking step 1645, unit PCB 410 determines if modular refrigeration unit 100 is currently being instructed by control panel 305 to run in a cooling mode. In an embodiment, unit PCB 410 makes this determination by examining the command state variable 1840 stored in memory of unit PCB 410. If control panel 305 has instructed modular refrigeration unit 100 to run in a cooling mode, then cooling operations method 1600 proceeds to water valve opening step 1665. Otherwise, cooling operations method 1600 proceeds to cooling disengaging step 1660.

In unit cavity high checking step 1650, unit PCB 410 compares the current cavity temperature obtained from unit thermometer 430 to a predefined set temperature, defined based on whether modular refrigeration unit 100 is operating as a freezer or as a refrigerator. In one embodiment, the predefined set temperature is 38 degrees Fahrenheit operating as a refrigerator and zero degrees Fahrenheit operating as a freezer. If the predefined set temperature is less than the cavity temperature, then cooling operations method 1600 proceeds to water valve opening step 1665. Otherwise, cooling operations method 1600 proceeds to unit cavity low checking step 1655.

In unit cavity low checking step 1655, unit PCB 410 compares the current cavity temperature obtained from unit thermometer 430 to the predefined set temperature discussed in unit cavity high checking step 1650. If the set the cavity temperature is more than two degrees lower than the predefined set temperature, then cooling operations method 1600 proceeds to cooling disengaging step 1660. Otherwise, cooling operations method 1600 proceeds to evaporator temperature checking step 1693. In other embodiments, the difference in temperatures may be more than, or less, than two degrees. We speculate that a two degree difference allows an interior space to become cool enough that modular refrigeration units 100 are turned on for a long enough period to achieve efficiency, but without the interior space being cooled to a temperature that varies too significantly from the predefined set temperature.

In cooling disengaging step 1660, unit PCB 410 closes liquid line solenoid valve 166 and water valve 171. In an embodiment, unit PCB 410 sets values in memory that results in the closing of liquid line solenoid valve 166 and water valve 171. Then, cooling operations method 1600 proceeds to second backup checking step 1685.

In water valve opening step 1665, unit PCB 410 starts a process for opening water valve 171. In an embodiment, unit PCB 410 sets a value in memory that results in the opening of water valve 171. Then, cooling operations method 1600 proceeds to solenoid delay step 1670.

In solenoid delay step 1670, unit PCB 410 determines if solenoid countdown timer variable 1860 has been set to zero. If solenoid countdown timer variable 1860 has been set to zero, cooling operations method 1600 proceeds to water valve checking step 1675. Otherwise, cooling operations method 1600 proceeds to cooling method ending step 1699. In one embodiment, solenoid countdown timer variable 1860 is set to a value of ten seconds upon initialization of unit PCB 410. We speculate that resetting solenoid countdown timer variable 1860 upon initialization and performing solenoid delay step 1670 prevents reduces the possibility that a reset during a defrost cycle (where hot gas solenoid valve 169 is used to pass non-chilled refrigerant 185 through piping 180 to defrost evaporator 150) will result in both liquid line solenoid valve 166 and hot gas solenoid valve 169 are open at the same time. The solenoid countdown timer variable 1860 is decremented in solenoid countdown timer decrementing step 1715 of service timing method 1700.

In water valve checking step 1675, unit PCB determines if water valve 171 is open. If so, cooling operations method 1600 proceeds to coolant engaging step 1680. Otherwise, cooling operations method proceeds to second backup checking step 1685.

In coolant engaging step 1680, unit PCB 410 opens liquid line solenoid valve 166. In an embodiment, unit PCB 410 sets values in memory that results in the closing of liquid line solenoid valve 166. Then, cooling operations method 1600 proceeds to second backup checking step 1685.

In second backup checking step 1685, unit PCB 410 determines if modular refrigeration unit 100 is operating in a backup mode. In an embodiment, unit PCB 410 determines if modular refrigeration unit 100 is operating in a backup mode by determining if a backup mode timer variable 1880 is set to zero. If modular refrigeration unit 100 is operating in backup mode, then cooling operations method 1600 proceeds to evaporator temperature checking step 1693. Otherwise, cooling operations method proceeds to fan state checking step 1690.

In fan state checking step 1690, unit PCB 410 determines if modular refrigeration unit 100 is currently being instructed by control panel 305 to engage axial fan 110. In an embodiment, unit PCB 410 makes this determination by examining the command state variable 1840 stored in memory of unit PCB 410. If control panel 305 has instructed modular refrigeration unit 100 to engage axial fan 110, then cooling operations method 1600 proceeds to evaporator temperature checking step 1693. Otherwise, cooling operations method 1600 proceeds to fan disengaging step 1695.

In evaporator temperature checking step 1693, unit PCB 410 compares the temperature of the evaporator 150 to a predetermined set temperature. If the evaporator temperature is lower than the predetermined set temperature, then cooling operations method 1600 proceeds to fan engaging step 1697. Otherwise, cooling operations method 1600 proceeds to fan disengaging step 1695. In this fashion, evaporator temperature checking step 1693 ensures that air within interior space 280 only blows across evaporator 150 when doing so will assist keeping interior space 280 at cooling/freezing temperatures. In an embodiment, the predetermined set temperature is 32 degrees Fahrenheit where modular refrigeration unit 100 is acting as a freezer, and the predetermined set temperature is 50 degrees Fahrenheit where modular refrigeration unit 100 is acting as a refrigerator. In an embodiment, unit PCB 410 determines the temperature of evaporator 150 by reading the current value of evaporator thermometer 440.

In fan disengaging step 1695, unit PCB 410 disengages axial fans 110 and records in memory that axial fans 110 are disengaged. In an embodiment, unit PCB 410 sets an actual state variable 1850 to indicate that axial fans 110 are disengaged. Cooling operations method 1600 then proceeds to cooling method ending step 1699.

In fan engaging step 1697, unit PCB 410 engages axial fans 110 and records in memory that axial fans 110 are engaged. In an embodiment, unit PCB 410 sets an actual state variable 1850 to indicate that axial fans 110 are engaged. Cooling operations method 1600 then proceeds to cooling method ending step 1699.

In cooling method ending step 1699, the subroutine implementing the steps of cooling operations method 1600 ends, and cooling operations method 1600 ends.

Figure 17:
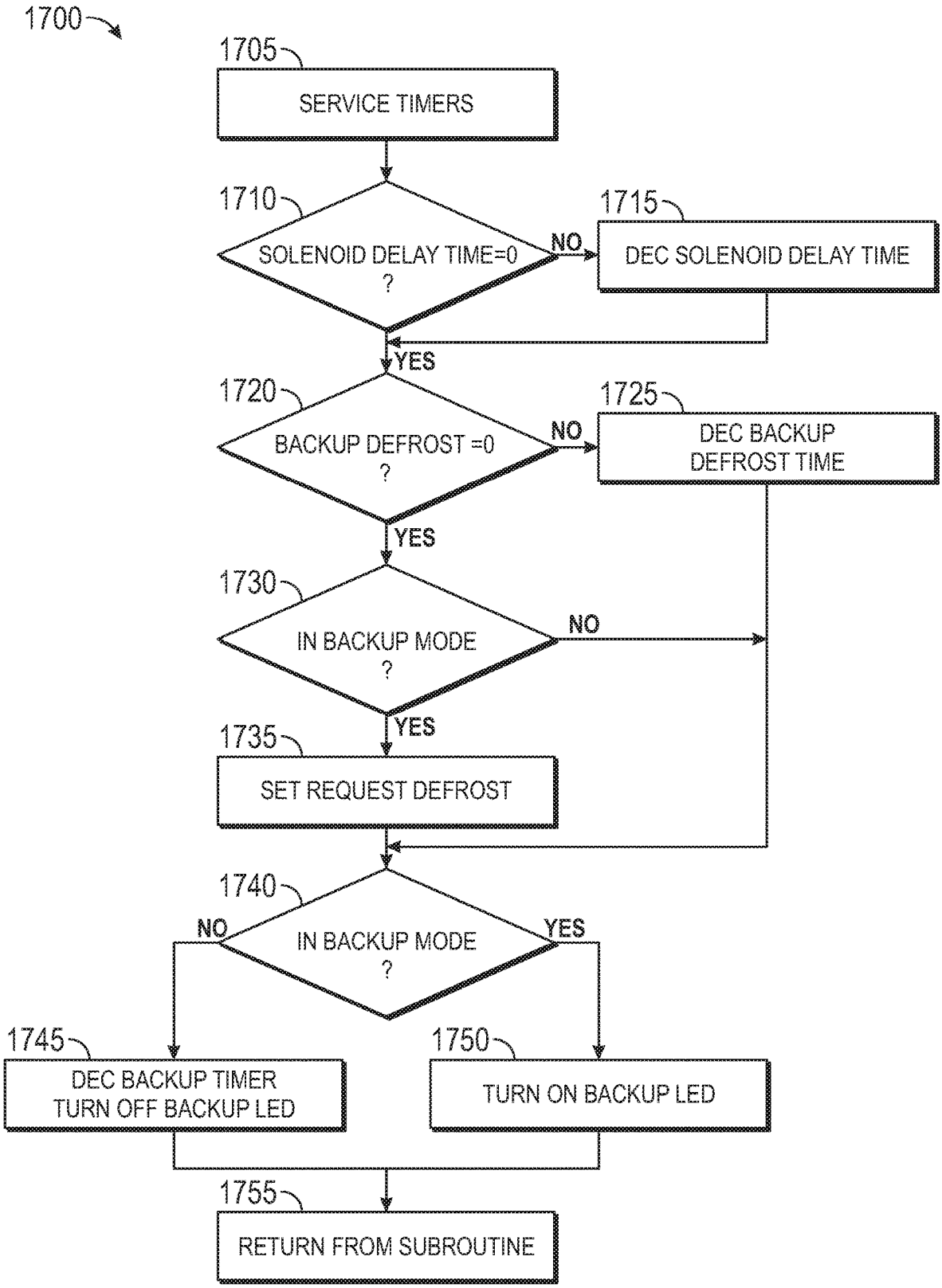
FIG. 17 is a block diagram depicting a method of controlling the timing of defrost cycles in a modular refrigeration unit.

FIG. 17. depicts an embodiment of service timing method 1700, whereby a control panel 305 adjusts one or more internal timers. In this embodiment, service timing method is implemented as an interrupt subroutine and executes once per second.

In service timing starting step 1705, unit PCB 410 begins executing a subroutine implementing the steps of service timing method 1700. Then, service timing method 1700 proceeds to solenoid timer step 1710.

In solenoid timer step 1710, unit PCB 410 determines if a solenoid countdown timer variable 1860 has been set to zero. If so, service timing method 1700 proceeds to defrost timer step 1720. Otherwise, service timing method 1700 proceeds to solenoid countdown timer decrementing step 1715.

In solenoid countdown timer decrementing step 1715, unit PCB410 decrements a solenoid countdown timer variable 1860 by a value equivalent to the interval between executions of service timing method 1700. In this embodiment, solenoid countdown timer variable 1860 is decremented by one. Service timing method 1700 then proceeds to defrost timer step 1720.

In defrost timer step 1720, unit PCB 410 determines if a unit defrost timer variable 1870 has been set to zero. If so, service timing method 1700 proceeds to third backup checking step 1730. Otherwise, service timing method 1700 proceeds to defrost timer decrementing step 1725.

In defrost timer decrementing step 1725, unit PCB 410 decrements unit defrost timer variable 1870 by a value equivalent to the interval between executions of service timing method 1700. In this embodiment, unit defrost timer variable 1870 is decremented by one. Service timing method 1700 then proceeds to fourth backup checking step 1740.

In third backup checking step 1730, unit PCB 410 determines if modular refrigeration unit 100 is operating in a backup mode. In an embodiment, unit PCB 410 determines if modular refrigeration unit 100 is operating in a backup mode by determining if a backup mode timer variable 1880 is set to zero. If modular refrigeration unit 100 is operating in backup mode, then service timing method 1700 proceeds to defrost requesting step 1735. Otherwise, service timing method 1700 proceeds to fourth backup checking step 1740.

In defrost requesting step 1735, unit PCB 410 instructs modular refrigeration unit 100 to enter defrost mode. In performing this step, unit PCB 410 has already determined that modular refrigeration unit 100 is in backup mode (i.e., communications have been severed with control panel 305) and a sufficient amount of time has passed since the last time modular refrigeration unit 100 entered defrost mode. Thus, defrost requesting step 1735 is modular refrigeration unit 100 entering defrost mode without instruction from control panel 305 to enter defrost mode. In an embodiment, unit PCB 410 instructs modular refrigeration unit 100 to enter defrost mode by recording in a command state variable 1840 the instruction to enter defrost mode. Service timing method 1700 then proceeds to fourth backup checking step 1740.

In another method implemented in one embodiment by an interrupt subroutine, if the command state variable 1840 read by unit PCB 410 indicates defrost mode, then unit PCB 410 engages defrost mode in modular refrigeration unit 100 for a predetermined period of time, resets the unit defrost timer variable 1870, and continues cooling operations. In one embodiment, the predetermined amount of time for engaging defrost mode is 15 minutes, and the unit defrost timer variable 1870 is reset to four hours.

In fourth backup checking step 1740, unit PCB 410 determines if modular refrigeration unit 100 is operating in a backup mode. In an embodiment, unit PCB 410 determines if modular refrigeration unit 100 is operating in a backup mode by determining if a backup mode timer variable 1880 is set to zero. If modular refrigeration unit 100 is operating in backup mode, then service timing method 1700 proceeds to second backup light engaging step 1750. Otherwise, service timing method 1700 proceeds to backup timer decrementing step 1745.

In backup timer decrementing step 1745, unit PCB 410 decrements a backup mode timer variable 1880 by a value equivalent to the interval between executions of service timing method 1700. In this embodiment, solenoid countdown timer variable 1860 is decremented by one. In this step, unit PCB410 also disengages an operation indicator 106 indicating that modular refrigeration unit 100 is operating in backup mode. Service timing method 1700 then proceeds to service timing ending step 1755.

In second backup light engaging step 1750, unit PCB410 engages an operation indicator 106 indicating that modular refrigeration unit 100 is operating in backup mode. Service timing method 1700 then proceeds to service timing ending step 1755.

In service timing ending step 1755, the subroutine implementing the steps of service timing method 1700 ends, and service timing method 1700 ends.

Collectively, module communications method 1500, cooling operations method 1600, and service timing method 1700 provide modularity and fault tolerance. More specifically, by receiving a command state variable 1840 from a control panel 305 in module communications method 1500, and by performing cooling operations method 1600 in view of the command state variable 1840, modular refrigeration unit 100 can be replaced by another modular refrigeration unit 100 to achieve the same result. In other words, a different embodiment of a modular refrigeration unit 100 may be used with the same control panel 305, and modularity is achieved if the modular refrigeration unit is able to perform cooling operations method 1600 and module communications method 1500, even if components within modular refrigeration unit 100 are different or are assembled in a different configuration. Additionally, the addition of service timing method 1700, in connection with cooling operations method 1600 allows a modular refrigeration unit 100 to operate even if communications with a control panel 305 are severed. This provides resiliency and reliability in view of potential service disruptions. Additionally, to ensure proper operation of a system when a unit has been replaced, control panel 305 and all modular refrigeration units 100 connected thereto should be powered down, with control panel 305 powered back on first, followed by each modular refrigeration unit 100.

Figure 18:
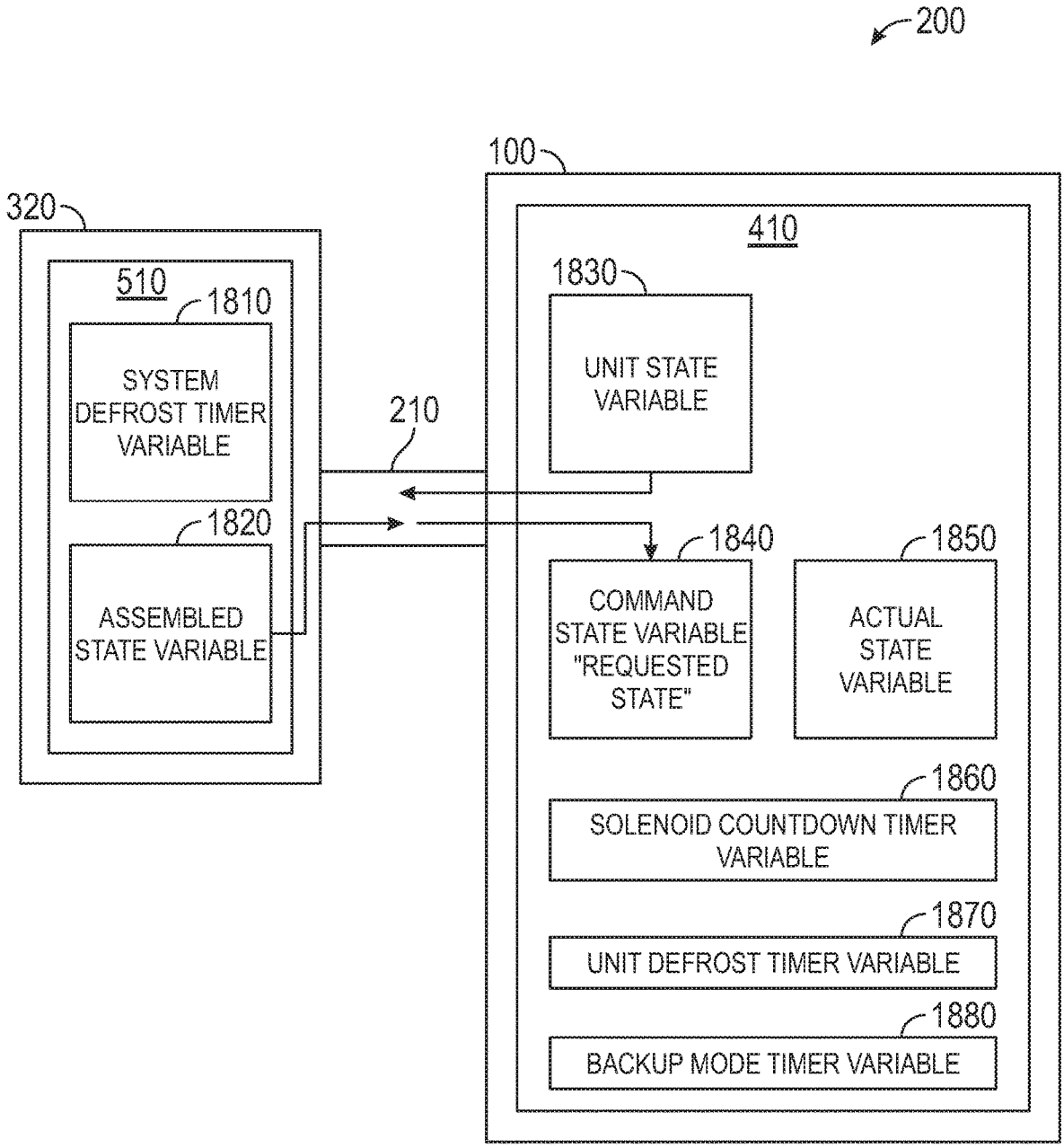
FIG. 18 is a block diagram depicting variables used in a modular refrigeration system.

FIG. 18 depicts an embodiment of modular refrigeration system 200 having a cooler control panel 320 with a cooler panel PCB 510 connected via communications cable 210 to a modular refrigeration unit 100 having a unit PCB 410. For illustrative purposes, variables discussed in the foregoing paragraphs are shown in FIG. 18. Although FIG. 18 depicts only a cooler control panel 320 having a cooler panel PCB 510, embodiments of a freezer control panel 310 having a freezer panel PCB 610 store data in the same variables as depicted inside cooler panel PCB510 in FIG. 18. In embodiments of modular refrigeration systems 200 having a plurality of modular refrigeration units 100, each of the plurality of modular refrigeration units 100 stores data in the same variables as depicted inside unit PCB 410 in FIG. 18.

The foregoing description of the embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated.

This invention is susceptible to considerable variation in its practice. Therefore, the foregoing description is not intended to limit, and should not be construed as limiting, the invention to the particular exemplifications presented hereinabove. Rather, what is intended to be covered is as set forth in the ensuing claims and the equivalents thereof as permitted as a matter of law.

| Parts List: | |
|---|---|
| 100 | Modular Refrigeration Unit |
| 105 | Operation Control Panel |
| 106 | Operation indicators |
| 107 | Operation Switch |
| 110 | Axial Fan |
| 111 | Axial Fan Cord |
| 120 | Input Power Socket |
| 121 | Communications Cable |
| 122 | Output Power Socket |
| 130 | Chilled Water Inlet |
| 135 | Chilled Water Outlet |
| 138 | Evaporator Enclosure |
| 139 | Main Body |
| 140 | Frame |
| 141 | Extension |
| 142 | Body Top Plate |
| 143 | First Body Side Plate |
| 144 | Body Rear Plate |
| 145 | Second Body Side Plate |
| 146 | Evaporator Enclosure Top Plate |
| 147 | Second Evaporator Enclosure Side Plate |
| 148 | First Evaporator Enclosure Side Plate |
| 149 | Evaporator Enclosure Bottom Plate |
| 150 | Evaporator |
| 151 | Nipple |
| 152 | Stainless Steel Union |
| 153 | Compressor |
| 154 | Refrigeration Check Valve |
| 155 | Electronic Expansion Valve |
| 156 | Electronic Super Heat Control |
| 157 | Electronic Super Heat Control Harness |
| 158 | Filter Dryer |
| 159 | Bell Reducer Fitting |
| 160 | Y Strainer Fitting |
| 161 | Fluid Flow Switch |
| 162 | Encapsulated Pressure Switch |
| 163 | Open Flow Water Coupling Socket |
| 164 | Open Flow Water Coupling Plug |
| 165 | Receiver Tank |
| 166 | Liquid Line Solenoid Valve |
| 167 | Sight Glass |
| 169 | Hot Gas Solenoid Valve |
| 170 | Pressure Transducer |
| 171 | Water Valve |

-continued

| Parts List: | |
|---|---|
| 172 | Heat Exchanger |
| 173 | Compressor Control |
| 180 | Piping |
| 185 | Refrigerant |
| 200 | Modular Refrigeration System |
| 210 | Communications Cable |
| 220 | Chilled Water Line |
| 230 | Chilled Water Return |
| 240 | Water Collection Pipe |
| 250 | Wall |
| 260 | Exterior Door |
| 261 | Interior Door |
| 270 | Ship Wall |
| 271 | Ship Structure |
| 272 | Ship Duct |
| 273 | Ship Beam |
| 275 | Maritime Vessel |
| 280 | Interior Space |
| 281 | Freezing Interior Space |
| 282 | Refrigerated Interior Space |
| 305 | Control Panel |
| 310 | Freezer Controller Panel |
| 311 | Freezer Alphanumeric Display |
| 312 | Freezer Temperature Decrease Button |
| 313 | Freezer Temperature Increase Button |
| 314 | Freezer Operating Indicators |
| 315A | Freezer Alarm Reset Button |
| 315F | Freezer Fault Display Button |
| 316 | Freezer Door Switch Cable |
| 317 | Freezer Cavity Temperature Cable |
| 318 | Freezer Alarm Cable |
| 319 | Freezer Panel Power Cable |
| 320 | Cooler Control Panel |
| 321 | Cooler Alphanumeric Display |
| 322 | Cooler Temperature Decrease Button |
| 323 | Cooler Temperature Increase Button |
| 324 | Cooler Operating Indicators |
| 325A | Cooler Alarm Reset Button |
| 325F | Cooler Fault Display Button |
| 326 | Cooler Door Switch Cable |
| 327 | Cooler Cavity Temperature Cable |
| 328 | Cooler Alarm Cable |
| 329 | Cooler Panel Power Cable |
| 330 | Man Trapped Alarm Panel |
| 334 | Interior Lighting Switch |
| 335 | Alarm Indicator |
| 336 | Man Trapped Output Cable |
| 337 | Man Trapped Alarm:Cable |
| 338 | Power Indicator |
| 339 | Man Trapped Panel Power Cable |
| 340 | interior cooler lights |
| 345 | and interior freezer lights |
| 350 | mullion heaters |
| 410 | Unit PCB |
| 420 | Unit Power Supply |
| 430 | Unit thermometer |
| 440 | Evaporator thermometer |
| 510 | Cooler Panel PCB |
| 520 | Cooler Thermometer |
| 530 | Cooler Panel Battery |
| 540 | Cooler Jumper |
| 610 | Freezer Panel PCB |
| 620 | Freezer Thermometer |
| 630 | Freezer Panel Battery |
| 640 | Freezer Jumper |
| 900 | Quick Release System |
| 910 | Mounting Bracket |
| 920 | Quick Release Socket |
| 930 | Quick Release Pin |
| 950 | Seam |

-continued

| Parts List: | |
|---|---|
| 1100 | User interaction method |
| 1110 | Initializing step |
| 1120 | Cavity temperature displaying step |
| 1125 | Switch checking step |
| 1130 | Up-switch pressed step |
| 1135 | Down-switch pressed step |
| 1140 | Alarm-switch pressed step |
| 1145 | Error-switch pressed step |
| 1150 | Temperature adjusting step |
| 1155 | Alarm silencing step |
| 1160 | Error displaying step |
| 1165 | Error-clear-checking step |
| 1170 | Error clearing step |
| 1200 | Temperature adjusting method |
| 1205 | Temperature Subroutine Beginning Step |
| 1210 | Cavity High Checking Step |
| 1215 | Cavity Low Checking Step |
| 1220 | Refrigerant-off step |
| 1225 | Refrigerant-on step |
| 1230 | Temperature Subroutine Ending Step |
| 1300 | Defrost Scheduling Method |
| 1305 | Scheduling Beginning step |
| 1310 | Counter Checking Step |
| 1315 | Counter Decrementing Step |
| 1320 | First Unit Checking Step |
| 1325 | Second Unit Checking Step |
| 1330 | Third Unit Checking Step |
| 1335 | Fourth Unit Checking Step |
| 1340 | Scheduling Ending Step |
| 1345 | Resetting Step |
| 1350 | First Unit Defrost Requesting Step |
| 1355 | Second Unit Defrost Requesting Step |
| 1360 | Third Unit Defrost Requesting Step |
| 1365 | Fourth Unit Defrost Requesting Step |
| 1400 | state transfer method |
| 1405 | Transfer starting step |
| 1410 | Data transfer step |
| 1415 | Transfer completion step |
| 1430 | state reading method |
| 1435 | State reading starting step |
| 1440 | Error checking step |
| 1445 | Defrost checking step |
| 1450 | Run Light Setting Step |
| 1455 | State Reading Ending Step |
| 1460 | Error Light Setting Step |
| 1465 | Defrost Light Setting Step |
| 1470 | Error Processing Method |
| 1475 | Error Processing Beginning Step |
| 1480 | Communications Checking Step |
| 1485 | Error Setting Step |
| 1490 | Error Checking Step |
| 1495 | Error Logging Step |
| 1497 | Error Processing Ending Step |
| 1500 | Module communications method |
| 1505 | Unit starting step |
| 1510 | Unit initializing step |
| 1520 | Data Receiving Step |
| 1525 | Command Processing Step |
| 1530 | Communications Synchronizing Step |
| 1535 | State Trans ission Step |
| 1540 | Data Sending Step |
| 1545 | Code Transmission Step |
| 1600 | Cooling operations method |
| 1605 | Cooling method starting step |
| 1610 | Mode setting step |
| 1615 | Unit defrost checking step |

-continued

| Parts List: | |
|---|---|
| 1620 | Unit error checking step |
| 1625 | Run state setting step |
| 1630 | First backup checking step |
| 1635 | Backup light disengaging step |
| 1640 | Backup light engaging step |
| 1645 | Cooling state checking step |
| 1650 | Unit Cavity High Checking Step |
| 1655 | Unit Cavity Low Checking Step |
| 1660 | Cooling disengaging step |
| 1665 | Water valve opening step |
| 1670 | Solenoid delay step |
| 1675 | Water valve checking step |
| 1680 | Coolant engaging step |
| 1685 | Second backup checking step |
| 1690 | Fan state checking step |
| 1693 | Evaporator temperature checking step |
| 1695 | Fan disengaging step |
| 1697 | Fan engaging step |
| 1699 | Cooling method ending step |
| 1700 | service timing method |
| 1705 | service timing starting step |
| 1710 | Solenoid timer step |
| 1715 | solenoid countdown timer decrementing step |
| 1720 | Defrost timer step |
| 1725 | Defrost timer decrementing step |
| 1730 | Third backup checking step |
| 1735 | Defrost requesting step |
| 1740 | Fourth backup checking step |
| 1745 | Backup timer decrementing step |
| 1750 | Second backup light engaging step |
| 1755 | Service timing ending step |
| 1810 | System defrost timer variable |
| 1820 | Assembled state variable |
| 1830 | Unit state variable |
| 1840 | Command state variable |
| 1850 | Actual state variable |
| 1860 | Solenoid countdown timer variable |
| 1870 | Unit defrost timer variable |
| 1880 | Backup mode timer variable |

The invention claimed is:

1. A refrigeration system comprising: a plurality of insulated walls forming an interior space; a plurality of modular refrigeration units capable of cooling said interior space, each comprising a heat exchanger, an evaporator, and a compressor; and a control panel capable of communication with each of said plurality of modular refrigeration units and capable of coordinating synchronous operation of said plurality of modular refrigeration units, wherein said plurality of insulated walls comprise a plurality of holes capable of receiving any one of said plurality of modular refrigeration units, wherein said control panel further comprises a panel thermometer capable of detecting an interior temperature of said interior space and said plurality of modular refrigeration units synchronously cool said interior space in response to said interior temperature when said plurality of modular refrigeration units are in communication with said control panel; and wherein said control panel is separate from each of said plurality of modular refrigeration units.

2. The refrigeration system of claim 1, wherein all of said plurality of modular refrigeration units are secured to said walls by quick connect pins.

3. The refrigeration system of claim 1, wherein all of said plurality of modular refrigeration units are secured to said walls by means for quickly connecting.

4. The refrigeration system of claim 1, wherein each of said plurality of modular refrigeration units further comprises a chilled water inlet and a chilled water outlet capable of accepting flow of chilled water and passing said chilled water through said heat exchanger.

5. The refrigeration system of claim 1, wherein each of said plurality of modular refrigeration units further comprises a unit thermometer capable of detecting a unit interior temperature of said interior space and when any one of said plurality of modular refrigeration units is not in communication with said control panel, said one of said plurality of modular refrigeration units cools said interior space in response to said unit interior temperature.

6. The refrigeration system of claim 5, wherein said control panel is capable of assembling a desired state for said plurality of modular refrigeration units and transferring said desired state to each of said plurality of modular refrigeration units, and wherein each of said plurality of modular refrigeration units is capable of receiving said desired state as a command state and cooling said interior space in response to said command state.

7. The refrigeration system of claim 6, wherein said control panel and said plurality of modular refrigeration units exchange data via a means for communicating.

8. The refrigeration system of claim 7, wherein each of said plurality of modular refrigeration units comprise a means for controlling cooling operations.

9. The refrigeration system of claim 1, wherein all of said plurality of modular refrigeration units are secured to said walls by means for quickly connecting;

wherein each of said plurality of modular refrigeration units further comprises a chilled water inlet and a chilled water outlet capable of accepting flow of chilled water and passing said chilled water through each respective said heat exchanger; and wherein each of said plurality of modular refrigeration units further comprises a unit thermometer capable of detecting a unit interior temperature of said interior space and when any one of said plurality of modular refrigeration units is not in communication with said control panel, said one of said plurality of modular refrigeration units cools said interior space in response to said unit interior temperature.

10. The refrigeration system of claim 9, wherein each of said plurality of modular refrigeration units further comprises an electronic super heat control further comprising a super heat thermometer capable of measuring a super heat temperature, an electronic expansion valve, piping, and refrigerant, wherein said refrigerant flows through said piping, across said electronic expansion valve, then through said evaporator, then past said electronic super heat control, wherein said electronic super heat control controls flow of refrigerant through electronic expansion valve in response to said super heat temperature.

11. A refrigeration system comprising: a plurality of insulated walls forming an interior space, wherein one or more of said plurality of insulated walls divides said interior space into a first interior space and a second interior space; a first plurality of modular refrigeration units capable of cooling said interior space, and a second plurality of modular refrigeration units, each comprising a heat exchanger, an evaporator, and a compressor; a first control panel capable of communication with each of said first plurality of modular refrigeration units and capable of coordinating synchronous operation of said first plurality of modular refrigeration units; and a second control panel capable of communication with each of said second plurality of modular refrigeration units and capable of coordinating synchronous operation of said second plurality of modular refrigeration units, wherein said plurality of insulated walls comprise a plurality of holes capable of receiving any one of said first plurality of modular refrigeration units and said second plurality of modular refrigeration units, wherein said first control panel further comprises a first panel thermometer capable of detecting a first interior temperature of said first interior space and said first plurality of modular refrigeration units synchronously cool said first interior space to a first maintenance temperature in response to said first interior temperature when said first plurality of modular refrigeration units are in communication with said first control panel, and wherein said second control panel further comprises a second panel thermometer capable of detecting a second interior temperature of said second interior space and said second plurality of modular refrigeration units synchronously cool said second interior space to a second maintenance temperature in response to said second interior temperature when said second plurality of modular refrigeration units are in communication with said second control panel.

12. The refrigeration system of claim 11, wherein said first maintenance temperature is either a refrigeration temperature or a freezing temperature and said second maintenance temperature is either a refrigeration temperature or a freezing temperature.

13. The refrigeration system of claim 12, wherein each of said first plurality of modular refrigeration units is interchangeable with each of said second plurality of modular refrigeration units.

14. The refrigeration system of claim 13, wherein input to said first control panel can cause a change in said first maintenance temperature and input to said second control panel can cause a change in said second maintenance temperature.

15. The refrigeration system of claim 13, wherein all of said first plurality of modular refrigeration units and all of said second plurality of modular refrigeration units are secured to said walls by quick connect pins.

16. The refrigeration system of claim 13, wherein all of said first plurality of modular refrigeration units and all of said second plurality of modular refrigeration units are secured to said walls by means for quickly connecting.

17. The refrigeration system of claim 13, wherein each of said first plurality of modular refrigeration units and each of said second plurality of modular refrigeration units further comprise a chilled water inlet and a chilled water outlet capable of accepting flow of chilled water and passing said chilled water through each respective said heat exchanger.

18. The refrigeration system of claim 13, wherein each of said first plurality of modular refrigeration units further comprises a first unit thermometer capable of detecting a first unit interior temperature of said first interior space and each of said second plurality of modular refrigeration units further comprises a second unit thermometer capable of detecting a second unit interior temperature of said second interior space, wherein when any one of said first plurality of modular refrigeration units is not in communication with said first control panel, said one of said first plurality of modular refrigeration units cools said first interior space in response to said first unit interior temperature; and wherein when any one of said second plurality of modular refrigeration units is not in communication with said second control panel, said one of said second plurality of modular refrigeration units cools said second interior space in response to said second unit interior temperature.

* * * * *